US005112729A

United States Patent [19]

Mihayashi

[11] Patent Number: 5,112,729

[45] Date of Patent: May 12, 1992

[54] SILVER HALIDE COLOR PHOTOGRAPHIC PHOTOSENSITIVE MATERIALS

[75] Inventor: Keiji Mihayashi, Kanagawa, Japan

[73] Assignee: Fuji Photo Film Co., Ltd., Kanagawa, Japan

[21] Appl. No.: 468,416

[22] Filed: Jan. 22, 1990

[30] Foreign Application Priority Data

Jan. 20, 1989 [JP] Japan ..... 1-11024

[51] Int. Cl.[5] ..... G03C 1/38

[52] U.S. Cl. ..... 430/546; 430/512; 430/552; 430/553; 430/931

[58] Field of Search ..... 430/546, 552, 553, 512, 430/931

[56] References Cited

U.S. PATENT DOCUMENTS 4,690,889 9/1987 Saito et al. ..... 430/552
4,748,107 5/1988 Umemoto et al. ..... 430/505

FOREIGN PATENT DOCUMENTS 0246616 11/1987 European Pat. Off. .
62-35356 2/1987 Japan .

*Primary Examiner*—Charles L. Bower, Jr.
*Assistant Examiner*—Janet C. Baxter
*Attorney, Agent, or Firm*—Sughrue, Mion, Zinn, Macpeak & Seas

[57] ABSTRACT

A silver halide color photographic photosensitive material which has at least one silver halide emulsion layer on a support, wherein at least one type of cyan coupler which is represented by general formula (A) indicated below is included in at least one layer, a high boiling point organic solvent is present in the layer which contains the coupler in a weight ratio with respect to the coupler in the layer of not more than 0.3, and an ultraviolet absorber is included in the layer at a rate of at least 0.05 in terms of the ratio by weight with respect to the cyan coupler:

(A)

wherein $R_1$, $R_2$, $R_3$, T, and l' are as defined in the specification.

14 Claims, No Drawings

SILVER HALIDE COLOR PHOTOGRAPHIC PHOTOSENSITIVE MATERIALS

FIELD OF THE INVENTION

The present invention relates to silver halide color photographic photosensitive materials and, more particularly, it relates to silver halide color photographic photosensitive materials which contain novel cyan couplers, and which, as sensitive materials, have excellent low temperature storage properties, and are excellent in respect of their colored image low temperature storage properties.

BACKGROUND OF THE INVENTION

It is well known that exposed silver halides act as oxidizing agents, that the oxidized form of primary aromatic amine developing agents react with couplers to produce indophenols, indoanilines, indamines, azomethines, phenoxazines, phenazines and similar dyes, and that a colored image can be formed in this way.

The phenol based couplers or naphthol based couplers known as cyan colored image forming couplers from among these couplers have disadvantages in that the fastness with respect to heat or light of the colored image which is formed by color development is sometimes low, and reduced color densities arise in cases where a bleach bath (bleach-fix bath) which has a weak oxidizing power, or a exhausted bleach bath (bleach-fix bath), is used. Naphthol based cyan couplers which are substituted in the 5-position have been proposed in European Patent (Laid Open) 161,626A (corresponding to U.S. Pat. No. 4,690,889) as couplers which are improved in this respect. The cyan dyes formed from these couplers have excellent light and heat fastness, and they are excellent in that virtually no spectral absorbance of the colored dye depends on the color density. Furthermore, the conjoint use of ultraviolet absorbers has been suggested in JP-A-62-35356 (the term "JP-A" as used herein refers to a "published unexamined Japanese patent application") with a view to improving the yellow staining due to the irradiation of these couplers with light.

High boiling point organic solvents in which the couplers dissolve generally are used to form emulsified dispersions, but there is a problem in that sharpness deteriorates when the naphthol couplers disclosed in European Patent 161,626A are used in a large amount with respect to the couplers of the high boiling point organic solvents, as disclosed in JP-A-62-269958 (corresponding to EP-A-246,616).

However, it has been found that there is a pronounced reduction in color forming performance when photosensitive materials in which only a small amount of high boiling point organic solvent is used relative to these couplers are stored at very low temperatures, and the storage stability of the emulsified dispersions is poor unless a large amount of high boiling point organic solvent is used relative to the couplers.

On the other hand, JP-A-53-110528 proposed the use of specified ultraviolet absorbers and cyan couplers in the same layer. But the cyan couplers disclosed in JP-A-53-110528 do not exhibit any behavior at very low temperatures which is seen in the present invention and the ultraviolet absorbers used in the present invention are not necessarily those which are specified in JP-A-53-110528. Thus, the present invention has different constitution and effect from those of JP-A-53-110528. Surprisingly, when sensitive materials in which cyan couplers of the present invention are incorporated together with a very small amount of high boiling point organic solvent are stored at very low temperatures, there is reduction in the color forming ability. This phenomenon does not occur with couplers known in the past other than those of the present invention.

SUMMARY OF THE INVENTION

A first object of the present invention is to provide silver halide color photographic photosensitive materials with which there is no change in color forming properties even on storage at very low temperatures (−15° C. and below).

A second object of the present invention is to provide photosensitive materials in which the coupler emulsions are stable with excellent production stability and a low production cost.

A third object of the present invention is to provide photosensitive materials which have excellent colored image storage properties after color development and with which there is little yellow staining.

A fourth object of the present invention is to provide photosensitive materials which have excellent film strength and excellent sharpness.

The above mentioned and other objects of the present invention can be achieved by a silver halide color photographic photosensitive material which has at least one silver halide emulsion layer on a support, wherein at least one type of cyan coupler which is represented by general formula (A) indicated below is included in at least one layer, a high boiling point organic solvent is present in the layer which contains the coupler in a weight ratio of not more than 0.3 with respect to the coupler in the layer, and an ultraviolet absorber is included in the layer at a rate of at least 0.05 in terms of the ratio by weight with respect to the cyan coupler.

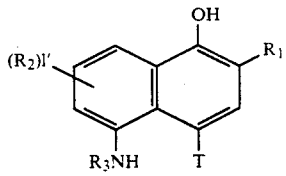

(A)

wherein $R_1$ represents a halogen atom, an aliphatic group, an aromatic group, a heterocyclic group, an amidino group, a guanidino group, or a $—COR_4$, $—SO_2R_4$, $—SOR_4$, $—NHCOR_4$, $—NHSO_2R_4$, $—NHSOR_4$, or $R_2$ represents a halogen atom, a hydroxyl group, a carboxyl group, a sulfo group, an amino group, a cyano group, a nitro group, an aliphatic group, an aromatic group, a carboxyamido group, a sulfonamido group, a carbamoyl group, a sulfamoyl group, a ureido group, an acyl group, an acyloxy group, an aliphatic oxy group, an aromatic oxy group, an aliphatic sulfonyl group, an aromatic sulfonyl group, an aliphatic sulfinyl group, an aromatic sulfinyl group, an aliphatic oxycarbonyl group, an aromatic oxycarbonyl group, an aliphatic oxycarbonylamino group, an aromatic oxycarbonylamino group, a sulfamoylamino group, a heterocyclic group or an imido group. l' represents an integer of from 0 to 3, $R_3$ represents a hydrogen atom or an $R_6U$ group, and T represents a hydrogen atom or a group which can be released by means of a coupling reaction with an oxidized form of a primary aromatic amine developing agent; $R_4$ and $R_5$ each independently represents an aliphatic group, an aromatic group, a heterocyclic group, an amino group, an aliphatic oxy group or an aromatic oxy group. $R_6$ represents a hydrogen atom, an aliphatic group, an aromatic group, a heterocyclic group, an $—OR_7$, $—SR_7$, $—COR_8$,

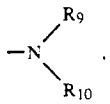

$—PO(R_7)_2$, $—PO(—OR_7)_2$,

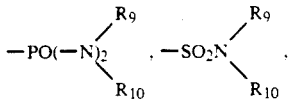

$—CO_2R_7$, $—SO_2R_7$ or $—SO_2OR_7$ group, or an imido group, and U represents

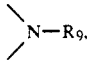

—CO—, $—SO_2—$, —SO— or a single bond; $R_7$ represents an aliphatic group, an aromatic group or a heterocyclic group, $R_8$ represents a hydrogen atom, an aliphatic group, an aromatic group or a heterocyclic group, and $R_9$ and $R_{10}$ each independently represents a hydrogen atom, an aliphatic group, an aromatic group, a heterocyclic group, an acyl group, an aliphatic sulfonyl group or an aromatic sulfonyl group; in those cases where l' is 2 or 3, the $R_2$ groups may be the same or different, and they may be joined together to form a ring; $R_2$ and $R_3$, or $R_3$ and T may be joined together to form a ring; and dimers or larger units (oligomers or polymers) can be formed by linking with divalent groups or groups of higher valency in any of the groups $R_1$, $R_2$, $R_3$ or T.

DETAILED DESCRIPTION OF THE INVENTION

The compounds which can be used in the present invention are described below.

In the above description of general formula (A), an aliphatic group may be a straight chain, branched or cyclic alkyl group, alkenyl group or alkynyl group, and these may be substituted or unsubstituted groups. An aromatic group signifies a substituted or unsubstituted aryl group, and this may have a condensed ring. The heterocyclic groups are substituted or unsubstituted single ring or condensed ring heterocyclic groups. Actual examples of aliphatic groups include methyl, ethyl, n-propyl, isopropyl, n-butyl, isobutyl, tert-butyl, cyclopentyl, t-pentyl, cyclohexyl, n-octyl, 2-ethylhexyl, n-decyl, n-dodecyl, n-tetradecyl, n-hexadecyl, n-octadecyl, 2-hexyldecyl, adamantyl, trifluoromethyl, carboxymethyl, methoxyethyl, vinyl, allyl, hydroxyethyl, heptafluoropropyl, benzyl, phenethyl, phenoxyethyl, methylsulfonylethyl, methylsulfonamidoethyl, 3-(2-ethylhexyloxy)propyl, 3-n-decyloxypropyl, 3-n-dodecyloxypropyl, 3-n-tetradecyloxypropyl, oleyl, propargyl, ethynyl, 3-(2,4-di-tert-pentylphenoxy)propyl, 4-(2,4-di-tert-pentylphenoxy)butyl, 1-(2,4-di-tert-pentylphenoxy)propyl, 1-(2,4-di-tert-pentylphenoxy)pentyl, 1-(3-tetradecylphenoxy)propyl and 2-n-dodecylthioethyl.

Actual examples of aromatic groups include phenyl, p-tolyl, m-tolyl, o-tolyl, 4-chlorophenyl, 4-nitrophenyl, 4-cyanopheny-1, 4-hydroxyphenyl, 3-hydroxyphenyl, 1-naphthyl, 2-naphthyl, o-biphenylyl, p-biphenylyl, pentafluorophenyl, 2-methoxyphenyl, 2-ethoxyphenyl, 4-methoxyphenyl, 4-tert-butylphenyl, 4-tert-octylphenyl, 4-carboxyphenyl, 4-methylsulfonamidophenyl, 4-(4-hydroxyphenylsulfonyl)phenyl, 2-n-tetradecyloxyphenyl, 4-n-tetradecyloxyphenyl, 2-chloro-5-n-dodecyloxyphenyl, 3-n-pentadecylphenyl, 2-chlorophenyl, 4-methoxycarbonylphenyl, 4-methylsulfonylphenyl and 2,4-di-tert-pentylphenyl.

Actual examples of heterocyclic groups include 2-pyridyl, 3-pyridyl, 4-pyridyl, 2-furyl, 2-thienyl, 3-thienyl, 4-quinolyl, 2-imidazolyl, 2-benzimidazolyl, 4-pyrazolyl, 2-benzoxazolyl, 2-benzothiazolyl, 1-imidazolyl, 1-pyrazolyl, 5-tetrazolyl, 1,3,4-thiadiazol-2-yl, 2-prolyl, 3-triazolyl, 4-oxazolyl, 4-thiazolyl, 2-pyrimidyl, 4-pyrimidyl, 1,3,5-triazin-2-yl, 1,3,4-oxadiazol-2-yl, 5-pyrazolyl, 2-pyrazyl, succinimido, phthalimido, morpholino, pyrrolidino, piperidino, imidazolin-2,4-dione-3-yl, imidazolidin-2,4-dione-1-yl and oxazolidin-2,4-dione-3-yl.

The individual substituent groups in general formula (A) are described in detail below.

$R_1$ in general formula (A) represents a halogen atom, an aliphatic group, an aromatic group, a heterocyclic group, an amidino group, a guanidino group or $—COR_4$, $—SO_2R_4$, $—SOR_4$, $—NHCOR_4$, $—NHSO_2R_4$, $—NHSOR_4$ or

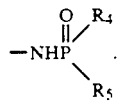

Here, $R_4$ and $R_5$ each independently represents an aliphatic group which has from 1 to 30 carbon atoms, an aromatic group which has from 6 to 30 carbon atoms, a heterocyclic group which has from 1 to 30 carbon atoms, an amino group which has from 0 to 30 carbon atoms (for example, amino, methylamino, dimethylamino, n-butylamino, anilino, N-(2-n-tetradecyloxyphenyl)amino, pyrrolidino, morpholino, piperidino, 2-ethylhexylamino, n-dodecylamino, N-methyl-N-dodecylamino, 3-dodecyloxypropylamino, 3-(2,4-di-tert-pentylphenoxy)propylamino, 4-(2,4-di-tert-pentylphenoxy)butylamino), an aliphatic oxy group which has from 1 to 30 carbon atoms (for example, methoxy, ethoxy, butoxy, methoxyethoxy, n-dodecyloxy, 3-(2,4-di-tert-pentylphenoxy)propoxy), or an aromatic oxy group which has from 6 to 30 carbon atoms (for example, phenoxy, 4-n-dodecyloxyphenoxy, 4-methoxycarbonylphenoxy). $R_4$ and $R_5$ may be joined together to form a ring. In those cases where $R_1$ represents a halogen atom, the halogen atom is a fluorine atom, a chlorine atom, a bromine atom or an iodine atom. In these cases where $R_1$ is an amidino group or a guanidino group, this group has from 1 to 30 carbon atoms in total, and may be substituted with aliphatic groups, aromatic groups, hydroxyl groups, aliphatic oxy groups, acyl groups, aliphatic sulfonyl groups, aromatic sulfonyl groups, acyloxy groups, aliphatic sulfonyloxy groups or aromatic sulfonyloxy groups, and two individual nitrogen atoms may be joined together to form a heterocyclic ring, such as an imidazole or benzimidazole, for example.

$R_2$ in general formula (A) represents a halogen atom (fluorine, chlorine, bromine, iodine), a hydroxyl group, a carboxyl group, a sulfo group, a cyano group, a nitro group, an amino group which has from 0 to 30 carbon atoms (for example, amino, methylamino, dimethylamino, pyrrolidino, anilino), an aliphatic group which has from 1 to 30 carbon atoms, an aromatic group which has from 6 to 30 carbon atoms, a carboxamido group which has from 1 to 30 carbon atoms (for example, formamido, acetamido, trifluoroacetamido, benzamido), a sulfonamido group which has from 1 to 30 carbon atoms (for example, methylsulfonamido, trifluoromethylsulfonamido, n-butylsulfonamido, p-tolylsulfonamido), a carbamoyl group which has from 1 to 30 carbon atoms (for example, carbamoyl, N,N-dimethylcarbamoyl, N-methylcarbamoyl, pyrrolidinocarbonyl, N-n-hexadecylcarbamoyl) a sulfamoyl group which has from 0 to 30 carbon atoms (for example, sulfamoyl, N-methylsulfamoyl, N,N-dimethylsulfamoyl, morpholinosulfonyl, N-n-dodecylsulfamoyl), a ureido group which has from 1 to 30 carbon atoms (for example, ureido, 3-methylureido, 3-phenylureido, 3,3-dimethylureido), an acyl group which has from 1 to 30 carbon atoms (for example, acetyl, pivaloyl, benzoyl, dodecanoyl), an acyloxy group which has from 1 to 30 carbon atoms (for example, acetoxy, benzoyloxy), an aliphatic oxy group which has from 1 to 30 carbon atoms, an aromatic oxy group which has from 6 to 30 carbon atoms, an aliphatic thio group which has from 1 to 30 carbon atoms, an aromatic thio group which has from 6 to 30 carbon atoms, an aliphatic sulfonyl group which has from 1 to 30 carbon atoms, an aromatic sulfonyl group which has from 6 to 30 carbon atoms, an aliphatic sulfinyl group which has from 1 to 30 carbon atoms, an aromatic sulfinyl group which has from 6 to 30 carbon atoms, an aliphatic oxycarbonyl group which has from 2 to 30 carbon atoms, an aromatic oxycarbonyl group which has from 7 to 30 carbon atoms, an aliphatic oxycarbonylamino group which has from 2 to 30 carbon atoms, an aromatic oxycarbonylamino group which has from 7 to 30 carbon atoms, a sulfamoylamino group which has from 0 to 30 carbon atoms (for example, sulfamoylamino, 3,3-dimethylsulfamoylamino, piperidinosulfonylamino), a heterocyclic group which has from 1 to 30 carbon atoms, or an imido group which has from 4 to 30 carbon atoms (for example, succinimido, maleinimido, phthalimido, diglycolimido, 4-nitrophthalimido).

$R_3$ in general formula (A) represents a hydrogen atom or an $R_6U$ group, where $R_6$ represents a hydrogen atom, an aliphatic group which has from 1 to 30 carbon atoms, an aromatic group which has from 6 to 30 carbon atoms, a heterocyclic group which has from 1 to 30 carbon atoms, an $—OR_7$, $—SR_7$, $—COR_8$,

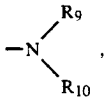

$—PO(R_7)_2$, $—PO(OR_7)_2$,

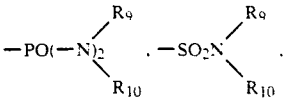

$—CO_2R_7$, $—SO_2R_7$, or $—SO_2OR_7$ group, or an imido group which has from 4 to 30 carbon atoms (for example, succinimido, maleinimido, phthalimido, diacetylamino), and U represents an

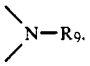

—CO—, $—SO_2—$ or —SO— group, or a single bond, $R_7$ represents a hydrogen atom, an aliphatic group which has from 1 to 30 carbon atoms, an aromatic group which has from 6 to 30 carbon atoms or a heterocyclic group which has from 1 to 30 carbon atoms, $R_8$ represents a hydrogen atom, an aliphatic group which has from 6 to 30 carbon atoms, an aromatic group which has from 6 to 30 carbon atoms, or a heterocyclic group which has from 1 to 30 carbon atoms, and $R_9$ and $R_{10}$ each independently represents a hydrogen atom, an aliphatic group which has from 1 to 30 carbon atoms, an aromatic group which has from 6 to 30 carbon atoms, a heterocyclic group which has from 1 to 30 carbon atoms, an acyl group which has from 1 to 30 carbon atoms (for example, acetyl, trifluoroacetyl, benzoyl, p-chlorobenzoyl) or a sulfonyl group which has from 1 to 30 carbon atoms (for example, methylsulfonyl, n-butylsulfonyl, phenylsulfonyl, p-nitrophenylsulfonyl). $R_9$ and $R_{10}$ may be joined together to form a ring.

T in general formula (A) represents a hydrogen atom or a group which can be released by means of a coupling reaction with an oxidized form of a primary aromatic amine developing agent. Examples of groups of the latter type include a halogen atom (fluorine, chlorine, bromine and iodine), a sulfo group, a thiocyanato group, an isothiocyanato group, a selenocyanato group, an aliphatic oxy group which has from 1 to 30 carbon atoms, an aromatic oxy group which has from 6 to 30 carbon atoms, an aliphatic thio group which has from 1 to 30 carbon atoms, an aromatic thio group which has from 6 to 30 carbon atoms, a heterocyclic thio group which has from 1 to 30 carbon atoms, a heterocyclic oxy group which has from 1 to 30 carbon atoms, an aromatic azo group which has from 6 to 30 carbon atoms, a heterocyclic group which has from 1 to 30 carbon atoms, an acyloxy group which has from 1 to 30 carbon atoms (for example, acetoxy, benzoyloxy), a sulfonyloxy group which has from 1 to 30 carbon atoms (for example, methylsulfonyloxy, p-tolylsulfonyloxy), a carbamoyloxy group which has from 1 to 30 carbon atoms (for example, N,N-dimethylcarbamoyloxy, pyrrolidinocarbonyloxy, N-ethylcarbamoyloxy), a thiocarbonyloxy group which has from 2 to 30 carbon atoms (for example, methylthiocarbonyloxy, phenylthiocarbonyloxy), and a carbonyldioxy group which has from 2 to 30 carbon atoms (for example, methoxycarbonyloxy, phenoxycarbonyloxy).

$R_2$ and $R_3$, $R_3$ and T, or a plurality of $R_2$ groups in general formula (A) can be joined together to form a ring. Examples in which $R_2$ and $R_3$ are joined together include $—CH_2CO—$, —OCO—, —NHCO—, —$C(CH_3)_2CO$— and —CH=CHCO—. Examples in which $R_3$ and T are joined together include —$CH_2CO$— and —COO—. Examples in which a plurality of $R_2$ groups are joined together include —$(CH_2)_3$—, —$(CH_2)_4$—, —OCO—, —OCONH—, —NHCONH—, —$(CH=CH)_2$—, —$OCH_2O$—, —$OCH_2CH_2O$—, and —$OC(CH_3)_2O$—.

Examples of the preferred substituent groups in compounds which can be represented by general formula (A) are described below.

$R_1$ in general formula (A) is preferably a halogen atom, —$COR_4$ or —$SO_2R_4$, and those cases in which $R_4$ is an amino group are especially desirable. Examples of —$COR_4$ include carbamoyl, N-ethylcarbamoyl, N-n-butylcarbamcyl, N-cyclohexylcarbamoyl, N-(2-ethylhexyl)carbamoyl, N-dodecylcarbamoyl, N-hexadecylcarbamoyl, N-(3-decyloxypropyl)carbamoyl, N-(3-dodecyloxypropyl)carbamoyl, N-[3-(2,4-di-tert-pentylphenoxy)propyl]carbamoyl, N-[4-(2,4-di-tert-pentylphenoxy)butyl]carbamoyl, N,N-dimethylcarbamoyl, N,N-dibutylcarbamoyl, N-methyl-N-dodecylcarbamoyl, morpholinocarbonyl, N-methyl-N-phenylcarbamoyl, N-(2-tetradecyloxyphenyl)carbamoyl, N-phenylcarbamoyl, N-(4-tetradecyloxyphenyl)carbamoyl, N-(2-propoxyphenyl)carbamoyl, N-(2-chloro-5-dodecyloxyphenyl)carbamoyl and N-(2-chlorophenyl)-carbamoyl, and examples of the —$SO_2R_4$ group include sulfamoyl, N-methylsulfamoyl, N,N-diethylsulfamoyl, N,N-diisopropylsulfamoyl, N-(3-dodecyloxypropyl)-sulfamoyl, N-[3-(2,4-di-tert-pentylphenoxy)propyl]sulfamoyl, N-[4-(2,4-di-tert-pentylphenoxy)butyl]sulfamoyl, pyrrolidinosulfonyl, N-phenylsulfamoyl, N-(2-butoxyphenyl)sulfamoyl and N-(2-tetradecyloxyphenyl)sulfamoyl. $R_1$ is most desirably a —$COR_4$ group (where $R_4$ is an amino group).

$R_2)_l$, in general formula (A) preferably has $l'=0$, and if $l'$ does not equal zero, $l'$ preferably equals 1. In those cases where $l'=1$, $R_2$ preferably represents a halogen atom, an aliphatic group, an aliphatic oxy group, a carboxamido group, a sulfonamido group or a cyano group, for example, and from among these groups a fluorine atom, a chlorine atom, a trifluoromethyl group, a methoxy group or a cyano group are the most desirable. The $R_2$ group is preferably substituted in the 2-position or the 4-position with respect to the $R_3NH$— group.

In $R_3$ in general formula (A , $R_6$ is preferably an aliphatic group, an aromatic group, —$OR_7$ or —$SR_7$, and U is preferably —CO— or —$SO_2$—. For $R_6$, examples of aliphatic groups include methyl, trifluoromethyl, trichloromethyl, ethyl, heptafluoropropyl, tert-butyl, 2-ethylpentyl, cyclohexyl, benzyl, undecyl, tridecyl and 1-(2,4-di-tert-pentylphenoxy)propyl, examples of aromatic groups include phenyl, 1-naphthyl, 2-naphthyl, 2-chlorophenyl, 4-methoxyphenyl, 4-nitrophenyl and pentafluorophenyl, examples of —$OR_7$ groups include methoxy, ethoxy, isopropoxy, n-butoxy, isobutoxy, tert-butoxy, n-pentyloxy, n-hexyloxy, n-octyloxy, 2-ethylhexyloxy, n-decyloxy, n-dodecyloxy, 2-methoxyethoxy, benzyloxy, trichloroethoxy, trifluoroethoxy, phenoxy and p-methylphenoxy, and examples of —$SR_7$ include methylthio, ethylthio, allylthio, n-butylthio, benzylthio, n-dodecylthio, phenylthio, p-tert-octylphenylthio, p-dodecylphenylthio and p-octyloxyphenylthio. $R_3$ is preferably an aliphatic oxycarbonyl group ($R_6$ is $R_7O$— and U is —CO—), or an aliphatic or aromatic sulfonyl group ($R_6$ is an aliphatic or aromatic group and U is —$SO_2$—), and it is most desirably an aliphatic oxycarbonyl group.

T in general formula (A) is preferably a hydrogen atom, a halogen atom, an aliphatic oxy group, an aromatic oxy group, an aliphatic thio group or a heterocyclic thio group. For T, examples of aliphatic oxy groups include methoxy, ethoxy, 2-hydroxyethoxy, 2-chloroethoxy, carboxymethoxy, 1-carboxyethoxy, methoxyethoxy, 2-(2-hydroxyethoxy)ethoxy, 2-methylsulfonylethoxy, 2-methylsulfonyloxyethoxy, 2-methylsulfonamidoethoxy, 2-carboxyethoxy, 3-carboxypropoxy, 2-(carboxymethylthio)ethoxy, 2-(1-carboxytridecylthio)ethoxy, 1-carboxytridecyloxy, N-(2-methoxyethyl)-carbamoylmethoxy, 1-imidazolylmethoxy and 5-phenoxycarbonylbenzotriazol-1-ylmethoxy, examples of aromatic oxy groups include 4-nitrophenoxy, 4-acetamidophenoxy, 2-acetamidophenoxy, 4-methylsulfonylphenoxy and 4-(3-carboxypropanamido)phenoxy, examples of aliphatic thio groups include methylthio, 2-hydroxyethylthio, carboxymethylthio, 2-carboxyethylthio, 1-carboxyethylthio, 3-carboxypropylthio, 2-dimethylaminoethylthio, benzylthio, n-dodecylthio and 1-carboxytridecylthio, and examples of heterocyclic thio groups include 1-phenyl-1,2,3,4-tetrazol-5-ylthio, 1-ethyl-1,2,3,4-tetrazol-5-ylthio, 1-(4-hydroxyphenyl)-1,2,3,4-tetrazol-5-ylthio, 4-phenyl-1,2,4-triazol-3-ylthio, 5-methyl-1,3,4-oxadiazol-2-ylthio, 1-(2-carboxyethyl)-1,2,3,4-tetrazol-5-ylthio, 5-methylthio-1,3,4-thiadiazol-2-ylthio, 5-methyl-1,3,4-thiadiazol-2-ylthio, 5-phenyl-1,3,4-oxadiazol-2-ylthio, 5-amino-1,3,4-thiadiazol-2-ylthio, benzoxazol-2-ylthio, 1-methylbenzimidazol-2-ylthio, 1-(2-dimethylaminophenyl)-1,2,3,4-tetrazol-5-ylthio, benzothiazol-2-ylthio, 5-(ethoxycarbonylmethylthio)-1,3,4-thiadiazol-2-ylthio, 1,2,4-triazol-3-ylthio, 4-pyridylthio and 2-pyrimidylthio. T is preferably a hydrogen atom, a chlorine atom, an aliphatic oxy group or an aliphatic thio group, and it is most desirably a hydrogen atom or an aliphatic oxy group.

The couplers represented by general formula (A) may take the form of dimers or larger polymers in which the coupler units are bonded with divalent groups or groups of higher valency via the $R_1$, $R_2$, $R_3$ or T substituent groups. In such cases, the number of carbon atoms may be any number sufficient for the couplers to have nondiffusibility.

Homopolymers or copolymers of addition polymerizable ethylenically unsaturated compounds which have cyan dye forming coupler residues (cyan color forming monomers) are typical of those cases in which couplers represented by general formula (A) take the form of a polymer. In such a case, the polymer contains repeating units of general formula (B), and one or more types of cyan color forming repeating units which can be represented by general formula (B) may be included in the polymer. Moreover, copolymers may contain one or more non-color forming ethylenic monomers as a copolymer component.

(B)

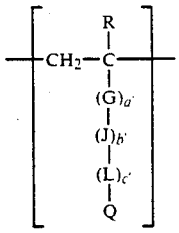

In general formula (B), R represents a hydrogen atom, an alkyl group which has from 1 to 4 carbon atoms or a chlorine atom, G represents —CONH—, —COO— or a substituted or unsubstituted phenylene group, J represents a substituted or unsubstituted alkylene group, phenylene group or aralkylene group, and L represents —CONH—, —NHCONH—, —NHCOO—, —NHCO—, —OCONH—, —NH—, —COO—, —OCO—, —CO—, —O—, $—SO_2—$, $—NHSO_2—$ or $—SO_2NH—$. Moreover, a', b' and c' each represents 0 or 1. Q represents a cyan coupler residual group in which a hydrogen atom other than that of the hydroxyl group in the 1-position has been removed from a compound which can be represented by general formula (A).

Copolymers of cyan color forming monomers which provide coupler units of general formula (B) and the noncolor forming ethylenic monomers described hereinafter are preferred as polymers.

Non-color forming ethylenic monomers which do not undergo coupling with the oxidation products of primary aromatic amine developing agents include acrylic acid, α-chloroacrylic acid, α-alkylacrylic acids (for example, methacrylic acid) and esters and amides derived from these acrylic acids (for example, acrylamide, methacrylamide, n-butylacrylamide, tert-butylacrylamide, diacetoneacrylamide, N-methylolacrylamide, N-(1,1-dimethyl-2-sulfonatoethyl)acrylamide, N-(3-sulfonatopropyl)acrylamide, methyl acrylate, ethyl acrylate, n-propyl acrylate, n-butyl acrylate, tert-butyl acrylate, isobutyl acrylate, acetoacetoxyethyl acrylate, n-hexyl acrylate, 2-ethylhexyl acrylate, n-octyl acrylate, lauryl acrylate, methyl methacrylate, ethyl methacrylate, n-butyl methacrylate and β-hydroxymethacrylate), vinyl esters (for example, vinyl acetate, vinyl propionate and vinyl laurate), acrylonitrile, methacrylonitrile, aromatic vinyl compounds (for example, styrene and derivatives thereof, such as vinyltoluene, divinylbenzene, potassium styrenesulfinate, vinylacetophenone and sulfostyrene), itaconic acid, citraconic acid, crotonic acid, vinylidene chloride, vinyl alkyl ethers (for example, vinyl ethyl ether), maleic acid esters, N-vinyl-2-pyrrolidone, N-vinylpyridine, and 2- and 4-vinylpyridine.

Acrylic acid esters, methacrylic acid esters and maleic acid esters are especially desirable. Two or more types of the non-color forming ethylenic monomers used here can be used conjointly. For example, methyl acrylate and butyl acrylate, butyl acrylate and styrene, butyl methacrylate and methacrylic acid, methyl acrylate and diacetoneacrylamide, N-(1,1-dimethyl-2-sulfonatoethyl)acrylamide and acrylic acid, and potassium styrenesulfinate and N-vinylpyrrolidone can be used.

The ethylene based unsaturated monomer for copolymerization with a vinyl based monomer corresponding to the aforementioned general formula (B) as known in the polymeric coupler field can be selected in such a way that the copolymer which is formed has favorable physical and chemical properties, for example, solubility, compatibility with the binder, such as gelatin, of photographic colloid compositions, and flexibility and thermal stability.

The selection of lipophilic non-color forming ethylenic monomers (for example, acrylic acid esters, methacrylic acid esters, maleic acid esters and vinyl benzenes) as the main copolymer component is preferred for realizing lipophilic polymeric couplers which are soluble in organic solvents.

A solution in an organic solvent of a lipophilic polymeric coupler obtained by polymerizing a vinyl based monomer which provides a coupler unit represented by the aforementioned general formula (B) can be emulsified and dispersed in the form of a latex in an aqueous gelatin solution, or a dispersion can be obtained by direct emulsification and dispersion in an aqueous gelatin solution.

A method for the emulsification and dispersion of lipophilic polymeric couplers in aqueous gelatin solutions in the form of a latex disclosed in U.S. Pat. No. 3,451,820 can be used, and the methods disclosed in U.S. Pat. Nos. 4,080,211 and 3,370,952 can be used for emulsion polymerization.

Moreover, the use of hydrophilic non-color forming ethylenic monomers, such as N-(1,1-dimethyl-2-sulfonatoethyl)acrylamide, 3-sulfonatopropyl acrylate, sodium styrenesulfonate, potassium 2-styrenesulfinate, acrylamide, methacrylamide, acrylic acid, methacrylic acid, N-vinylpyrrolidone and N-vinylpyridine, for example, is preferred for obtaining hydrophilic polymeric couplers which are soluble in neutral or alkaline water.

Hydrophilic polymeric couplers can be added to the coating liquid in the form of an aqueous solution, and they can also be added after dissolution in a mixed solvent comprising water and an organic solvent which is miscible with water, such as a lower alcohol, tetrahydrofuran, acetone, ethyl acetate, cyclohexane, ethyl lactate, dimethylformamide, or dimethylacetamide, for example. They may also be added in the form of an alkaline aqueous solution or after dissolution in an alkali containing organic solvent. A small quantity of surfactant can also be added.

Actual examples of couplers which can be represented by general formula (A) which can be used in the present invention are indicated below, but the invention is not limited by the examples.

(A-1)

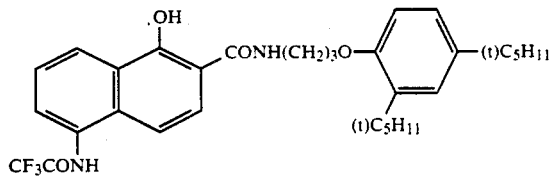

-continued
(A-2)
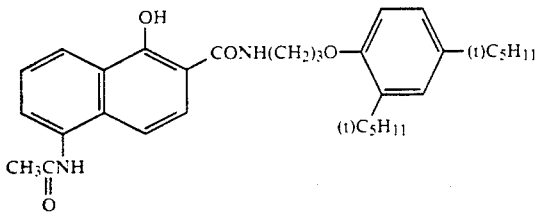
(A-3)
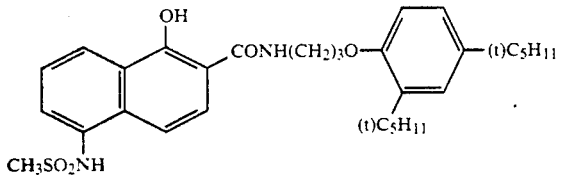
(A-4)
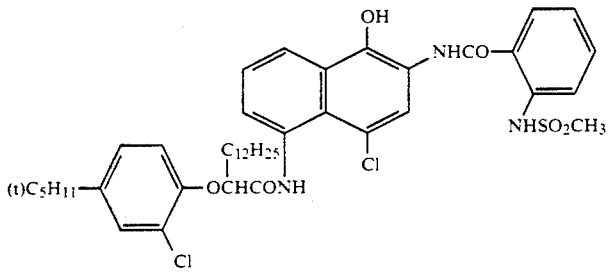
(A-5)
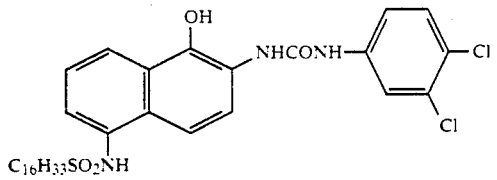
(A-6)
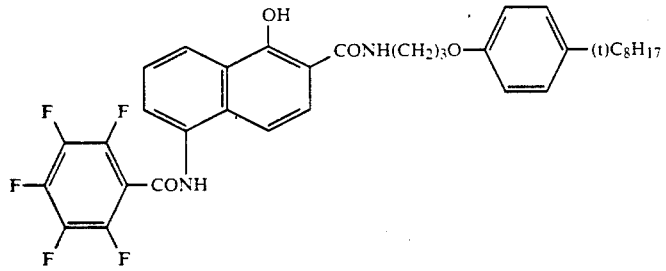
(A-7)
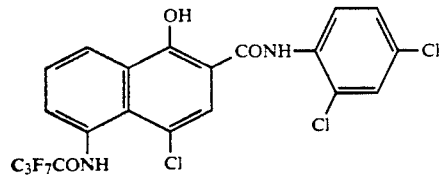
(A-8)
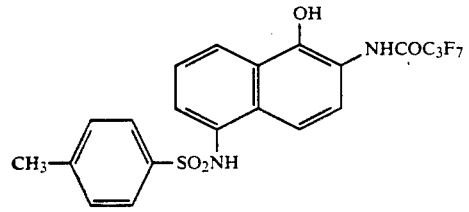

-continued
(A-9)
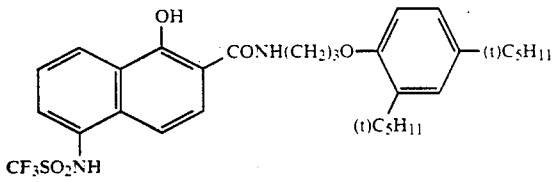
(A-10)
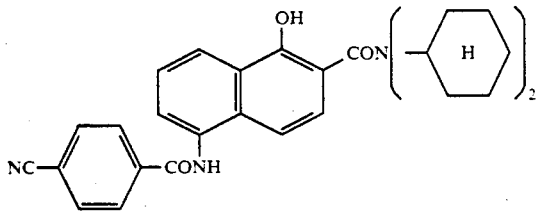
(A-11)
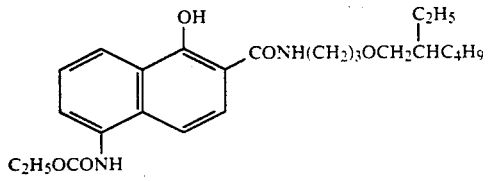
(A-12)
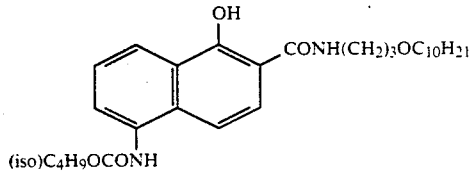
(A-13)
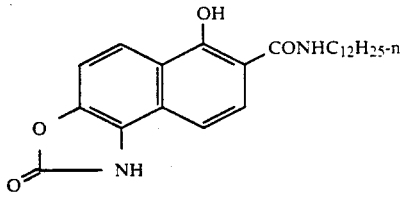
(A-14)
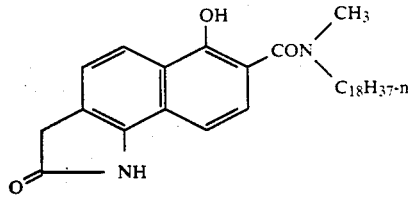
(A-15)
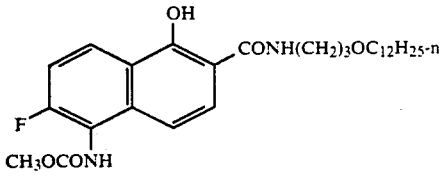
(A-16)
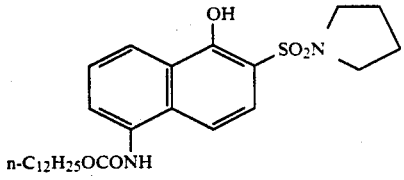

-continued
(A-17)
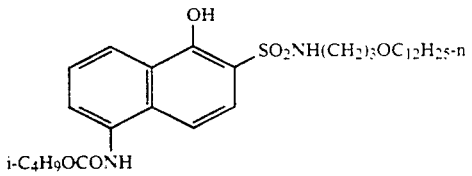
(A-18)
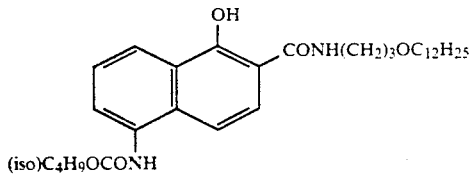
(A-19)
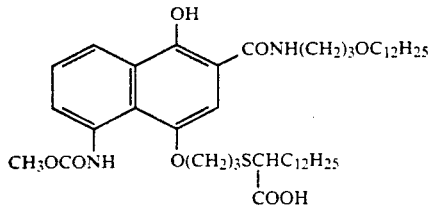
(A-20)
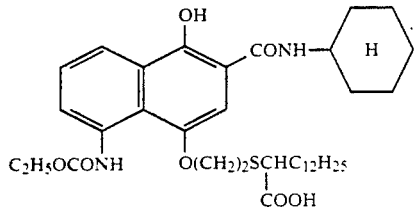
(A-21)
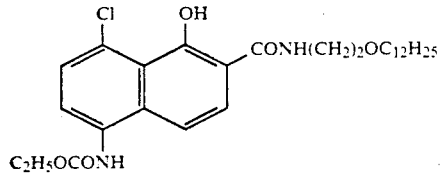
(A-22)
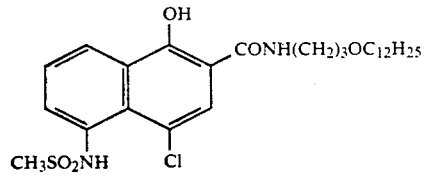
(A-23)
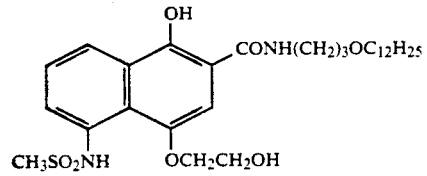
(A-24)
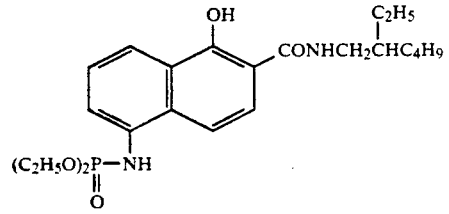

-continued
(A-25)
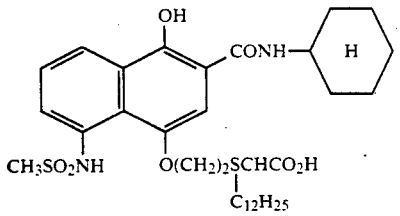
(A-26)
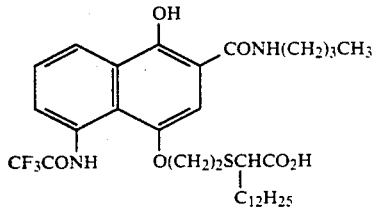
(A-27)
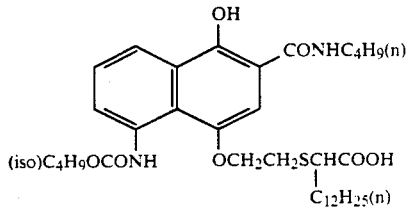
(A-28)
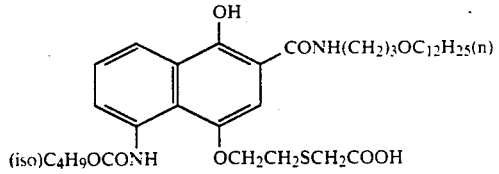
(A-29)
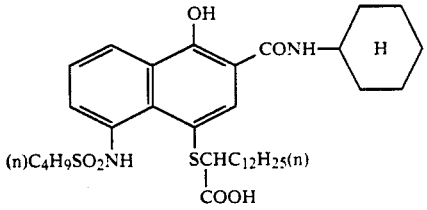
(A-30)
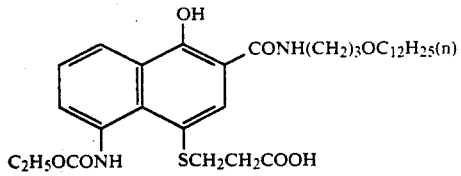
(A-31)
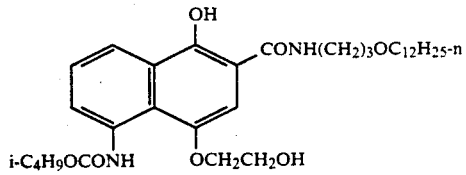
(A-32)
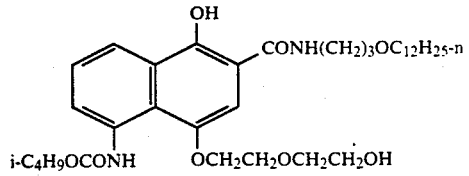

-continued
(A-33)
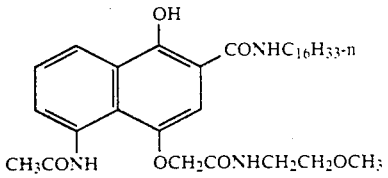
(A-34)
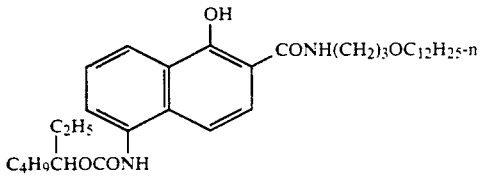
(A-35)
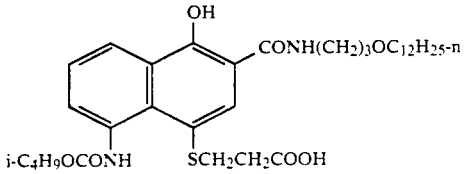
(A-36)
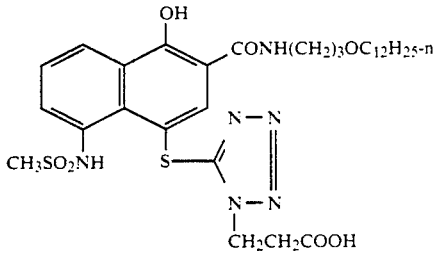
(A-37)
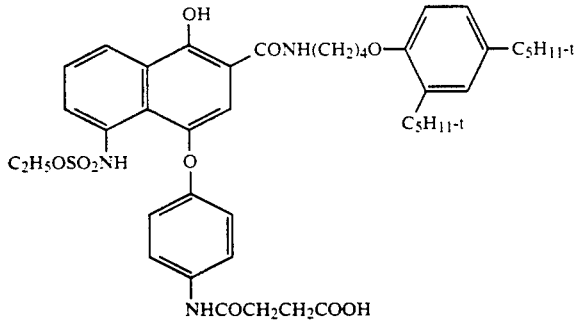
(A-38)
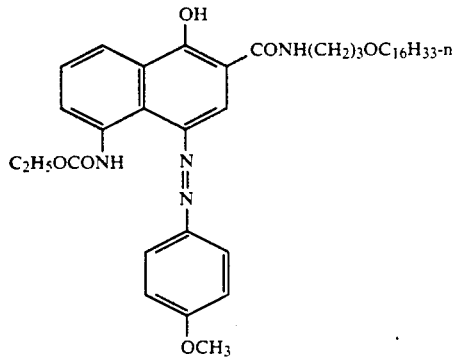

-continued
(A-39)
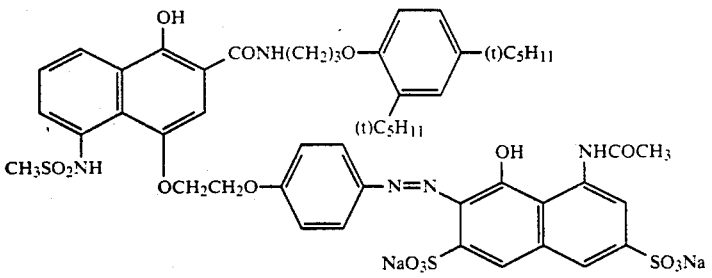
(A-40)
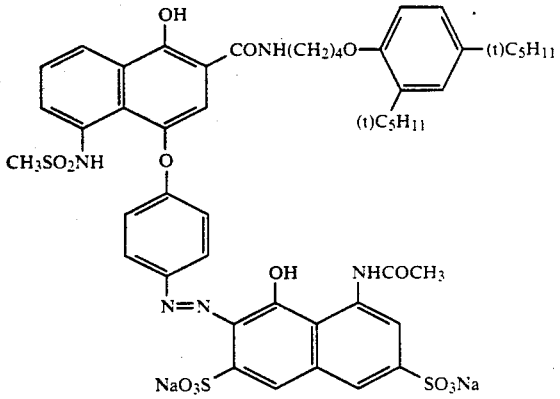
(A-41)
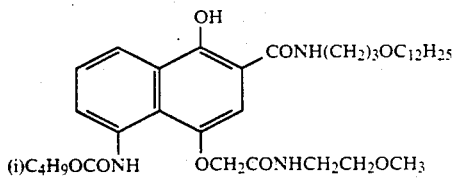
(A-42)
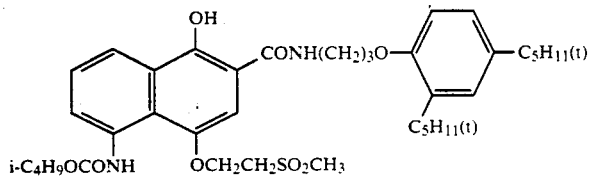
(A-43)
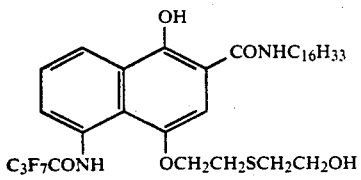
(A-44)
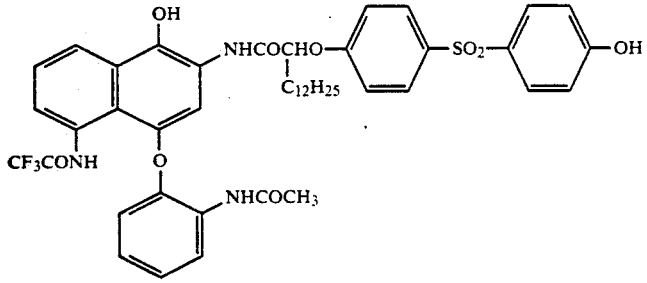

-continued
(A-45)
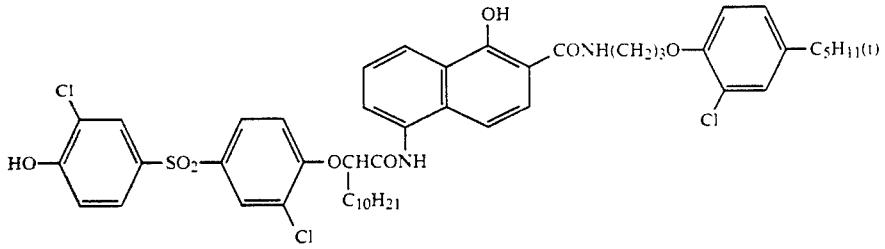
(A-46)
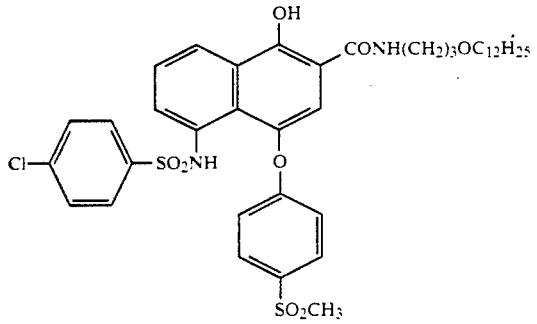
(A-47)
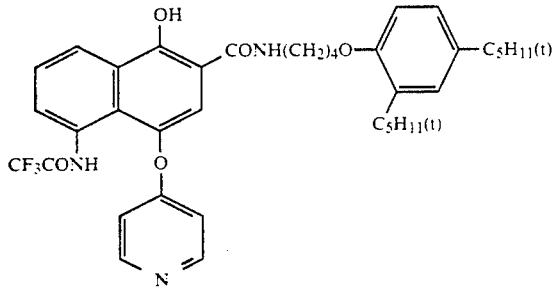
(A-48)
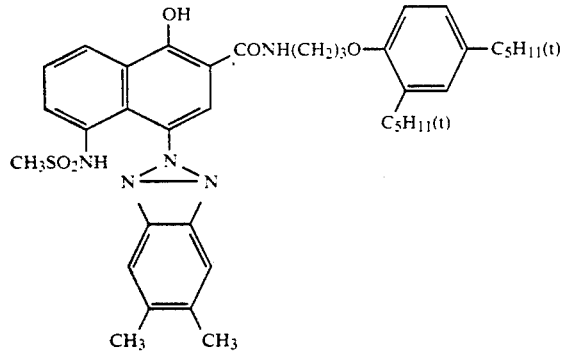
(A-49)
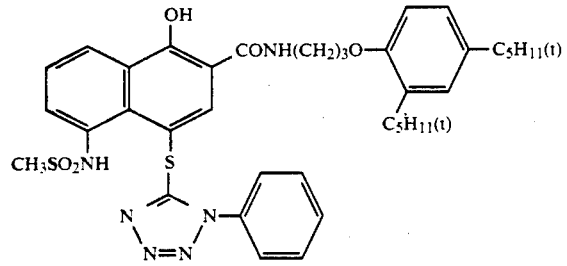

-continued
(A-50)
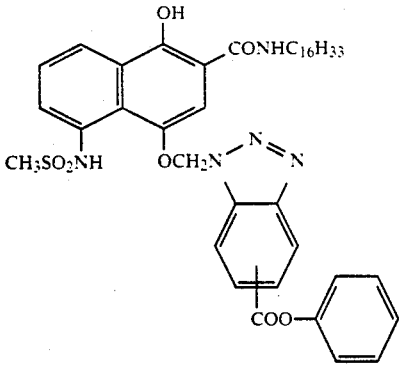
(A-51)
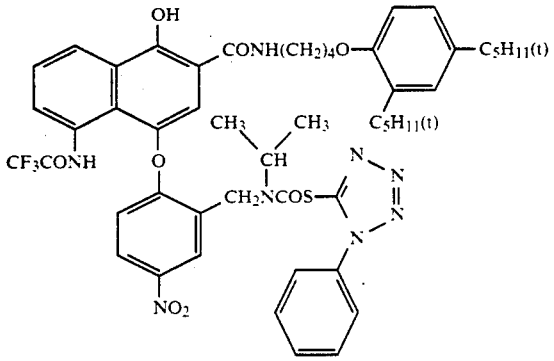
(A-52)
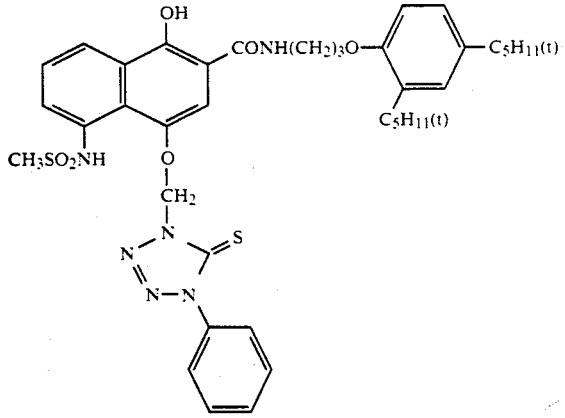
(A-53)
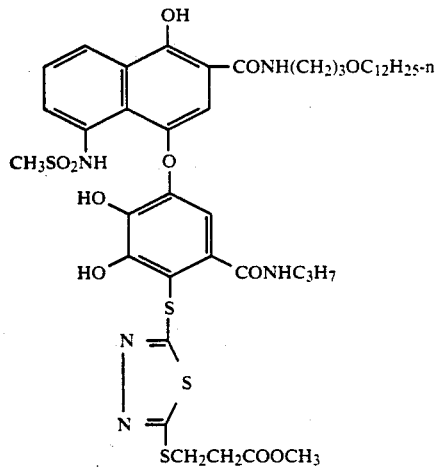

-continued
(A-54)
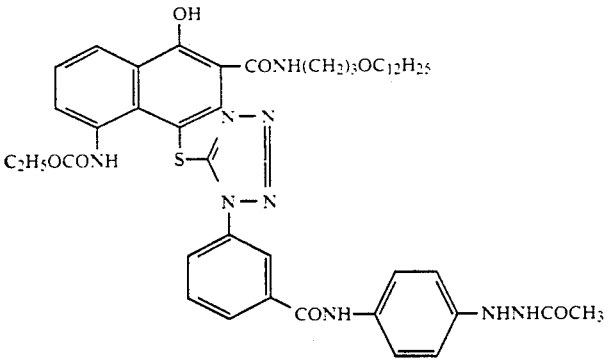
(A-55)
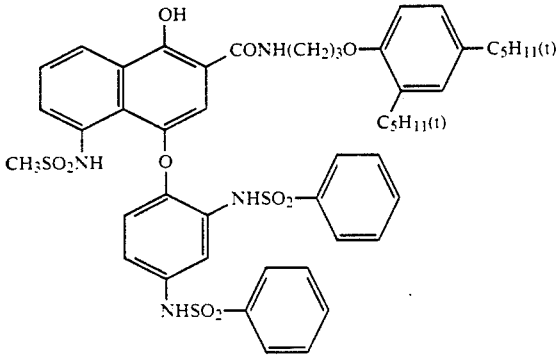
(A-56)
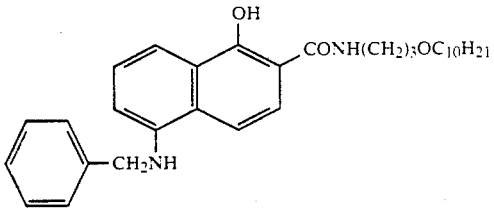
(A-57)
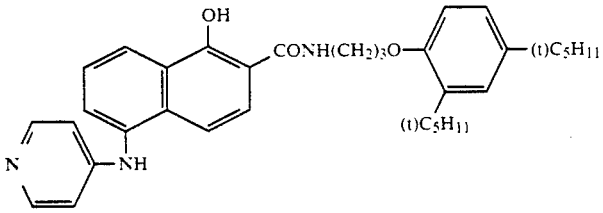
(A-58)
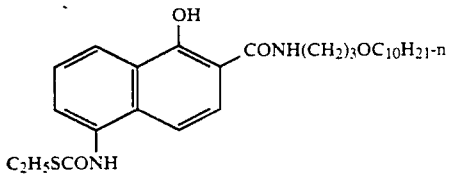
(A-59)
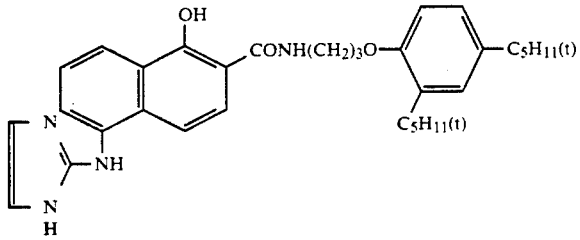

-continued
(A-60)
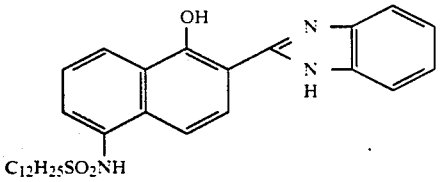
(A-61)
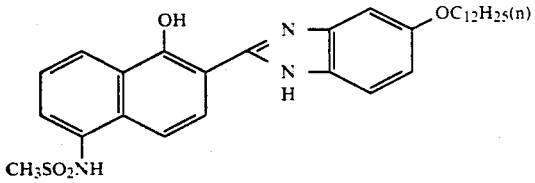
(A-62)
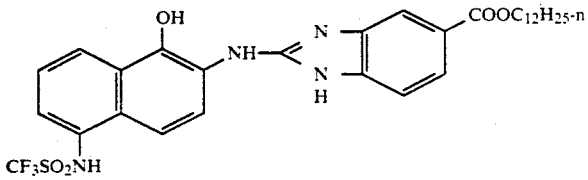
(A-63)
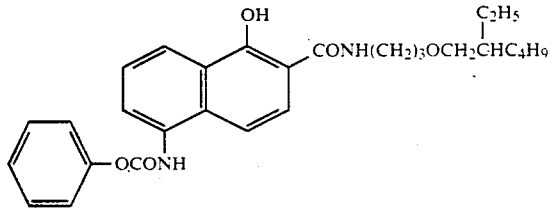
(A-64)
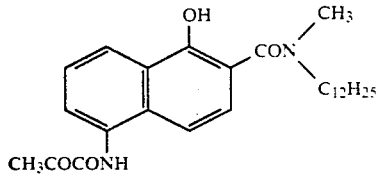
(A-65)
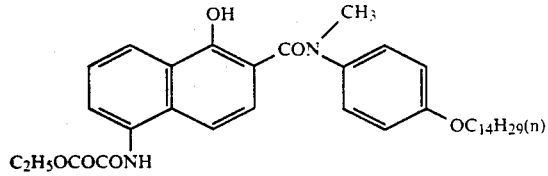
(A-66)
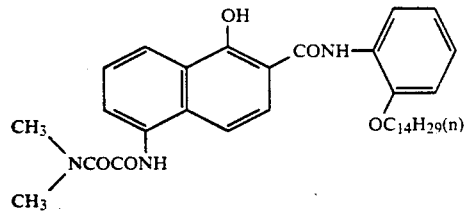
(A-67)
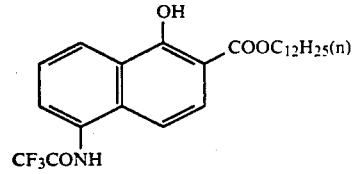

-continued
(A-68)
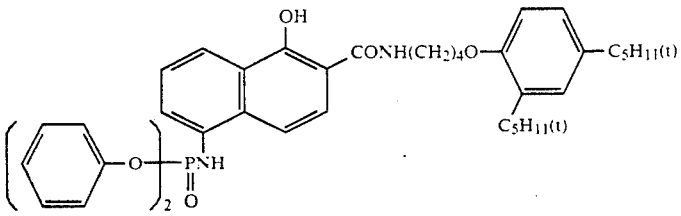
(A-69)
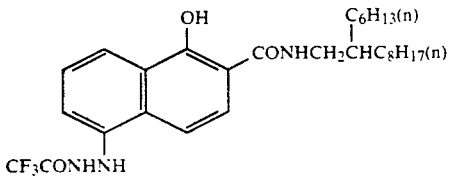
(A-70)
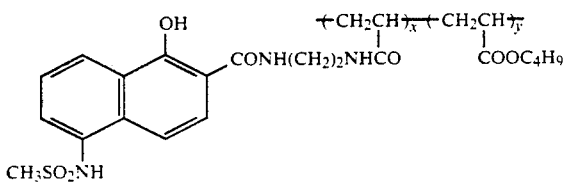
x:y = 70:30 (by weight)
(A-71)
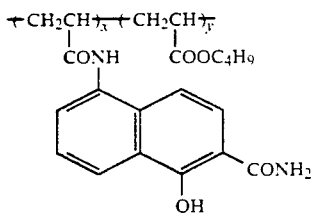
x:y = 55:45 (by weight)
(A-72)
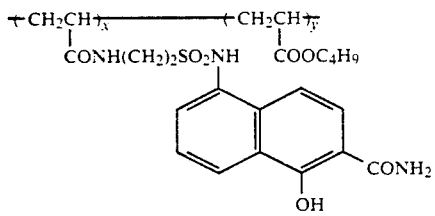
x:y = 80:20 (by weight)
(A-73)
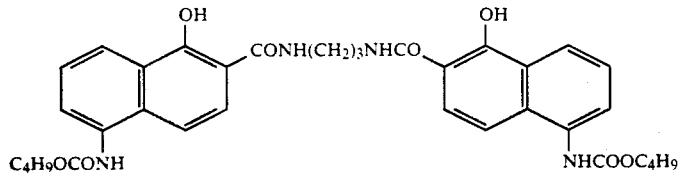
(A-74)
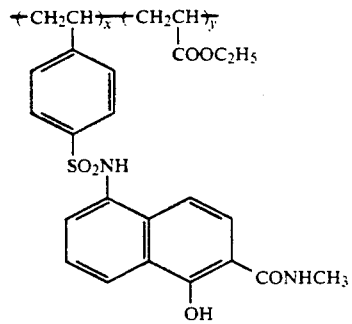
x:y = 60:40 (by weight)

-continued (A-75)

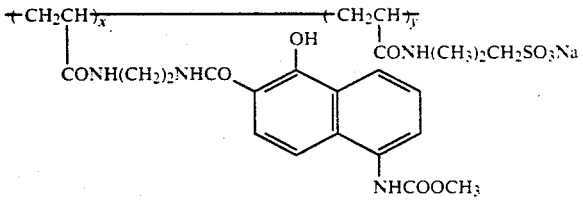

x:y = 50:50 (by weight)

As well as those indicated above, examples of couplers represented by general formula (A) which can be used in the present invention have been disclosed in JP-A-60-237448 (corresponding to U.S. Pat. No. 4,690,889), JP-A-61-153640, JP-A-61-145557 and JP-A-63-208042. Furthermore, these couplers can be prepared using the methods disclosed in the above mentioned patent documents and the methods disclosed in JP-A-62-123157, JP-A-62-123158 and JP-A-63-258446.

The ultraviolet absorbers used in the present invention are described below.

Benzotriazole compounds which have aryl substituent groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,375), butadiene compounds (for example, those disclosed in U.S. Pat. No. 4,045,229) or benzoxazole compounds (for example, those disclosed in U.S. Pat. No. 3,700,455) can be used, for example, as the ultraviolet absorbers which are used in the present invention. Moreover, the ultraviolet absorbers disclosed in U.S. Pat. No. 3,499,762 and JP-A-54-48535 can also be used. Ultraviolet absorbing couplers (for example, α-naphthol based cyan dye forming couplers) and ultraviolet absorbing polymers can also be used. These ultraviolet absorbers are preferably lipophilic materials.

These ultraviolet absorbers may be used individually, or two or more types may be used conjointly.

The preferred ultraviolet absorbers for use in the present invention can be represented by the following general formulae (I) to (IV).

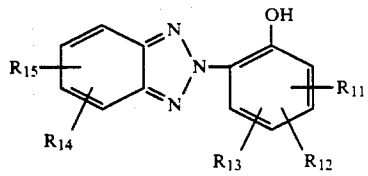

(I)

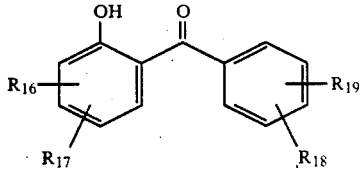

(II)

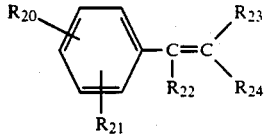

(III)

-continued

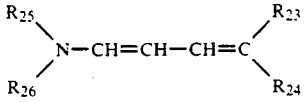

(IV)

In the above mentioned general formulae (I) to (IV), $R_{11}$ to $R_{15}$, which may be the same or different, each represents a hydrogen atom, a halogen atom, an acyloxy group having from 1 to 18 carbon atoms, an aliphatic group having from 1 to 18 carbon atoms, an aromatic group having from 6 to 24 carbon atoms, $R_{27}O$— or $R_{27}SO_2$—, $R_{16}$ to $R_{19}$, which may be the same or different, each represents a hydrogen atom, a halogen atom, a hydroxyl group, an aliphatic group having from 1 to 18 carbon atoms, an aromatic group having from 6 to 24 carbon atoms, a carboxamido group, a sulfonamido group, a sulfo group, a carboxyl group or $R_{27}O$—, $R_{20}$ and $R_{21}$, which may be the same or different, each represents a hydrogen atom, an aliphatic group having from 1 to 18 carbon atoms, a halogen atom or $R_{27}O$—, $R_{22}$, $R_{25}$ and $R_{26}$, which may be the same or different, each represents a hydrogen atom, an aliphatic group having from 1 to 18 carbon atoms, or an aromatic group having from 6 to 24 carbon atoms (but both $R_{25}$ and $R_{26}$ cannot both be hydrogen atoms at the same time), $R_{23}$ and $R_{24}$, which may be the same or different, each represents a cyano group, a carbamoyl group, a sulfamoyl group, a formyl group, —$COR_{27}$, —$SOR_{27}$, —$SO_2R_{27}$, —$SO_2OR_{27}$ or —$COOR_{27}$, and $R_{27}$ represents an aliphatic group having from 1 to 18 carbon atoms or an aromatic group having from 6 to 24 carbon atoms. In the above groups $R_{11}$ to $R_{27}$, an aliphatic group is a substituted or unsubstituted straight chain, branched chain or cyclic alkyl group, and an aromatic group is a group which has a substituted or unsubstituted single benzene ring or condensed benzene ring.

Examples of the substituent groups $R_{11}$ to $R_{27}$ used in the compounds represented by general formulae (I) to (IV) are indicated below.

That is to say, these substituent groups include a halogen atom (for example, fluorine, chlorine, bromine), an aliphatic group (for example, methyl, ethyl, n-propyl, isopropyl, sec-butyl, tert-butyl, tert-amyl, tert-hexyl, n-octyl, 2-ethylhexyl, tert-octyl, dodecyl, hexadecyl, trifluoroacetyl, benzyl), an aromatic group (for example, phenyl, tolyl, 4-methoxyphenyl, naphthyl), an acyloxy group (for example, acetyloxy, benzoyloxy, p-chlorobenzoyloxy), a carboxamido group (for example, acetamido, benzamido, trifluoroacetamido), a sulfonamido group (for example, methanesulfonamido, benzenesulfonamido, toluenesulfonamido), a carbamoyl group (for example, carbamoyl, dimethylcarbamoyl, dodecylcarbamoyl), and a sulfamoyl group (for example, sulfamoyl, dimethylsulfamoyl, phenylsulfamoyl).

The compounds represented by general formulae (I) to (IV) may form dimers or larger polymers by bonding via any of the groups $R_{11}$ to $R_{27}$, and polymer like compounds by bonding to a main polymer chain via any of the groups $R_{11}$ to $R_{27}$ can also be formed.

Examples of compounds which can be represented by general formulae (I) to (IV) ar indicated below.

UV-1

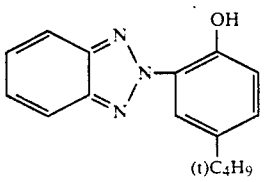

UV-2

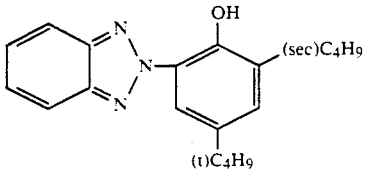

UV-3

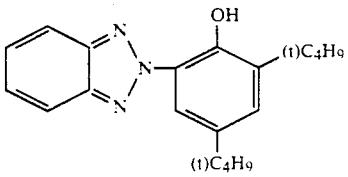

UV-4

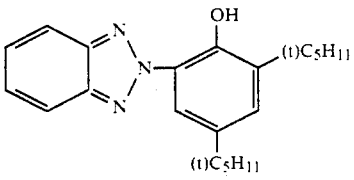

UV-5

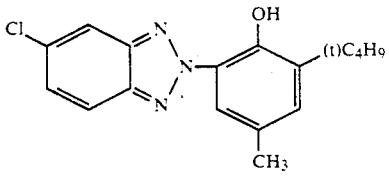

UV-6

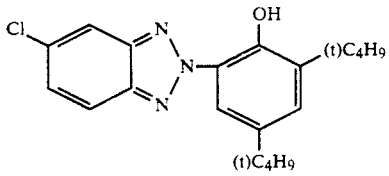

UV-7

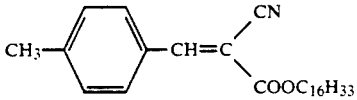

UV-8

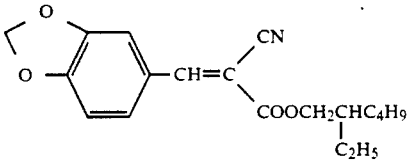

-continued

UV-9

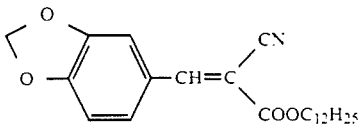

UV-10

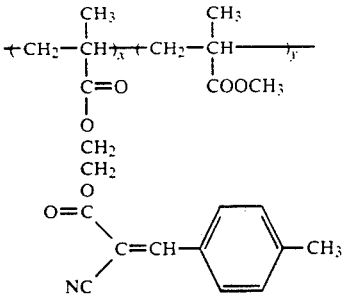

x:y = 7:3 (by weight)

UV-11

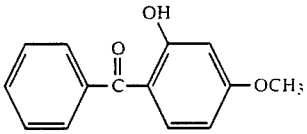

UV-12

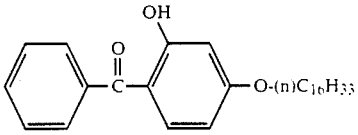

UV-13

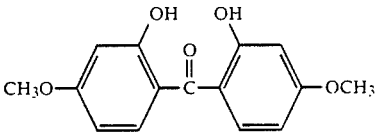

UV-14

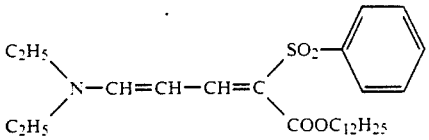

UV-15

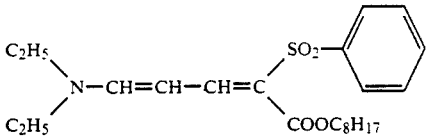

UV-16

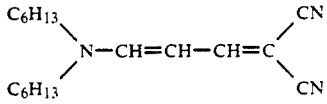

UV-17

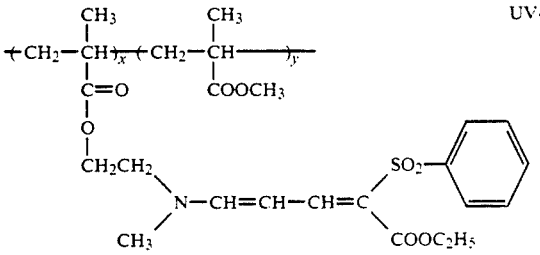

x:y = 80:20 (by weight)

The high boiling point solvents employed in the present invention have a boiling point at normal pressure (760 mm Hg) of at least 175° C.

Examples of high boiling point organic solvents which can be used together with the couplers represented by general formula (A) include a phosphoric acid ester (for example, triphenyl phosphate, tricresyl phosphate, octyl diphenyl phosphate, tri-2-ethylhexyl phosphate, tri-n-hexyl phosphate, triisononyl phosphate, tricyclohexyl phosphate, tributoxyethyl phosphate, tri-2-chloroethyl phosphate), a benzoic acid ester (for example, 2-ethylhexyl benzoate, 2-ethylhexyl 2,4-dichlorobenzoate), a fatty acid ester (for example, di-2-ethylhexyl succinate, 2-hexyldecyl tetradecanoate, tributyl citrate), an amide (for example, N,N-diethyldodecanamide, N-tetradecylpyrrolidone), a dialkylaniline (for example, 2-butoxy-5-tert-octyl-N,N-dibutylaniline), a chlorinated paraffin (for example, a paraffin which has a chlorine content of from 10% to 80%), a phenol (for example, 2,5-di-tert-amylphenol, 2,5-di-tert-hexyl-4-methoxyphenol, 2-ethylhexyl p-hydroxybenzoate), and a phthalic acid ester (for example, dibutyl phthalate, dicyclohexyl phthalate, diheptyl phthalate, di-2-ethylhexyl phthalate, didodecyl phthalate), but the use of a phosphoric acid ester and a phthalic acid ester is especially desirable.

The amount of the high boiling point organic solvent added in the present invention is determined with respect to the total weight of coupler contained in a single layer and is at the most 0.3 g per g of coupler. Deterioration in sharpness becomes a problem if a larger quantity of high boiling point organic solvent is used. The amount used is preferably 0.15 g per g of coupler, more desirably 0.05 g per g of coupler, and most desirably not more than 0.01 g per g of coupler, and it may be 0 g.

The total weight of coupler in this case is the total weight of all the cyan couplers included in a silver halide emulsion layer which contains at least one type of cyan coupler which can be represented by general formula (A).

The ratio by weight of the ultraviolet absorber with respect to the cyan coupler represented by general formula (A) should be at least 0.05, and it is preferably from 0.10 to 0.80, and most desirably from 0.20 to 0.50.

The cyan coupler of the present invention and the ultraviolet absorber must be present in the same layer, and it is desirable that this layer and/or the layer adjacent to this layer should be a red sensitive silver halide emulsion layer.

The total amount of cyan coupler of the present invention which is added is from 0.01 to 2.0 g, preferably from 0.05 to 1.5 g, and most desirably from 0.2 to 1.0 g, per square meter of photosensitive material.

The ratio by weight of the organic component with respect to the binder which are included in the emulsion layer which contains the cyan coupler of the present invention is preferably from 0.2 to 1.0.

The ratio of the organic component with respect to the binder is defined in the following way. Thus, the organic component signifies the organic compounds of which at least 5 wt % is insoluble in water, including, for example, couplers, colored couplers, development inhibitor releasing couplers and high boiling point organic solvents, for example. In most cases, the binder is gelatin, but in cases where a synthetic polymer is used conjointly, the synthetic polymer is included in the calculation as binder. The ratio is expressed in terms of the weight of each of these materials. Polymeric couplers are included in the calculation as organic components. In the present invention, the ratio of organic components and binder is preferably between 0.2 and 1.0, and most desirably between 0.2 and 0.8. If the value exceeds 0.8 the film strength of the photosensitive material may be weakened, coupler may diffuse between layers, and the high boiling point organic solvent is liable to bleed out. Furthermore, peeling is liable to occur at the interface with other layers. If the value of this ratio is less than 0.2, the amount of binder is excessive, development is slow, there is an adverse effect on sharpness and this is undesirable.

With photosensitive materials in which only an amount of high boiling point organic solvent such that the ratio by weight with respect to the cyan coupler of the present invention is not more than 0.3 is included, the coupler forms a stable intermediate phase which is not crystalline and not oil-like on storing the photosensitive materials under very low temperature conditions below −15° C., for example, and the color forming properties are clearly adversely affected on color development after returning to room temperature. It has been discovered that the stable intermediate phase can be observed by subjecting the coated film to differential thermal analysis.

In photosensitive materials which have the construction of the present invention, which is to say in which an ultraviolet absorber is added to the photosensitive material in an amount of at least 0.05 times by weight with respect to the coupler of the present invention, there is no loss of color forming properties even on storage at very low temperatures, and it is clear from the result of differential thermal analysis that the above mentioned stable phase is unlikely to be formed.

The photosensitive materials of the present invention should have, on a support, at least one blue sensitive layer, at least one green sensitive layer and at least one red sensitive layer, but no particular limitation is imposed upon the number or order of the silver halide emulsion and nonphotosensitive layers. Typically, silver halide photographic materials have, on a support, at least one photosensitive layer comprised of a plurality of silver halide layers which have essentially the same color sensitivity but different photographic speeds, and said photosensitive layer is a photosensitive layer unit which is color sensitive to blue light, green light or red light, and in multilayer silver halide color photographic materials, the arrangement of the photosensitive layer units generally involves the location of the layers in the order, from the support side, of a red sensitive layer, a green sensitive layer, a blue sensitive layer. However, this order may be reversed, as required, and the layers may be arranged in such a way that layers which have a different color sensitivity are sandwiched between layers which have the same color sensitivity.

Various nonphotosensitive layers, such as intermediate layers, may be established between the silver halide photosensitive layers, and uppermost and lowermost nonphotosensitive layers may be established above and below the uppermost and lowermost silver halide photosensitive layers.

The intermediate layers may contain couplers and DIR compounds such as those disclosed in the specifications of JP-A-61-43748, JP-A-59-113438, JP-A-59-113440, JP-A-61-20037 and JP-A-61-20038, and they may also contain anti-color mixing compounds which are normally used.

The plurality of silver halide emulsion layers constituting each unit photosensitive layer is preferably a double layer structure comprised of a high speed emulsion layer and a low speed emulsion layer as disclosed in West German Patent 1,121,470 or British Patent 923,045. Normally, arrangements in which the photographic speed is lower in the layer closer to the support are preferred, and nonphotosensitive layers may be established between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, layers can be arranged in the order, from the side furthest from the support, of blue sensitive layer/GH/RH/GL/RL as disclosed in JP-B-55-34932 (the term "JP-B" as used herein refers to an "examined Japanese patent publication"). Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, arrangements in which there are three layers which have different speeds, with the speed decreasing towards the support, that is, with a high speed silver halide emulsion layer at the top, a silver halide emulsion layer which has a lower speed than the aforementioned top layer as an intermediate layer and a silver halide emulsion layer which has a lower speed than the intermediate layer as a bottom layer, as disclosed in JP-B-49-15495, can also be used. In the case of structures of this type which have three layers of different speeds, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

As described above, various layer structures and arrangements can be selected, respectively, according to the purpose of the photosensitive materials.

The preferred silver halides for inclusion in the photographic emulsion layers are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 25 mol % of silver iodide.

The silver halide grains in the photographic emulsion may have a regular crystalline form, such as a cubic, octahedral or tetradecahedral form, an irregular crystalline form, such as a spherical or tabular form, a form which has crystal defects, such as twinned crystal planes, or a form which is a composite of these forms.

The grain size of the silver halide may be very fine, at least that about 0.2 μm, or large with a projected area diameter of up to about 10 μm, and the emulsions may be polydisperse emulsions or monodisperse emulsions.

The photographic emulsions which can be used in the present invention can be prepared, for example, using the methods disclosed in *Research Disclosure (RD)*, No. 17643 (December, 1978), pages 22–23, "I. Emulsion Preparation and Types"; *Research Disclosure*, No. 18716 (November, 1979), page 648; by P. Glafkides in *Chimie et Physique Photographique*, published by Paul Montel, 1966; by G. F. Duffin in *Photographic Emulsion Chemistry*, published by Focal Press, 1966; and by V. L. Zelikman et al. in *Making and Coating Photographic Emulsions* published by Focal Press, 1964.

The monodispersions disclosed, for example, in U.S. Pat. Nos. 3,574,628 and 3,655,394, and British Patent 1,413,748 are preferred.

Furthermore, tabular grains which have an aspect ratio of at least about 5 can be used in the present invention. Tabular grains can be prepared easily using the methods described, for example, by Gutoff in *Photographic Science and Engineering*, Vol. 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layered structure and, moreover, silver halides which have different compositions may be joined with an epitaxial junction or they may be joined with compounds other than silver halides, such as silver thiocyanate or lead oxide, for example.

Mixtures of grains which have various crystalline forms can also be used.

The silver halide emulsions used have normally been subjected to physical ripening, chemical ripening and spectral sensitization. Additives which are used in such processes have been disclosed in *Research Disclosure*, Nos. 17643 and 18716, and the locations of these disclosures are summarized in the table below.

Known photographically useful additives which can be used in the present invention are also disclosed in the two *Research Disclosures* referred to above, and the locations of these disclosures are also indicated in the table below.

| Additives | RD 17643 | RD 18716 |
|---|---|---|
| 1. Chemical Sensitizers | Page 23 | Page 648, right column |
| 2. Speed Increasing Agents | — | Page 648, right column |
| 3. Spectral Sensitizers and Supersensitizers | Pages 23–24 | Page 648, right column to page 649, right column |
| 4. Whiteners | Page 24 | — |
| 5. Antifoggants and Stabilizers | Pages 24–25 | Page 649, right column |
| 6. Light Absorbers, Filter Dyes, and Ultraviolet Absorbers | Pages 25–26 | Page 649, right column to page 650, left column |
| 7. Stain Inhibitors | Page 25, right column | Page 650, left to right columns |
| 8. Dye Image Stabilizers | Page 25 | — |
| 9. Film Hardening Agents | Page 26 | Page 651, left column |
| 10. Binders | Page 26 | Page 651, left column |
| 11. Plasticizers, Lubricants | Page 27 | Page 650, right column |
| 12. Coating Promotors, Surfactants | Pages 26–27 | Page 650, right column |
| 13. Antistatic Agents | Page 27 | Page 650, right column |

Furthermore, the addition of compounds which can react with and fix formaldehyde, as disclosed in U.S. Pat. Nos. 4,411,987 and 4,435,503, to the photosensitive material is desirable for preventing any worsening of photographic performance due to formaldehyde gas.

Various color couplers can be used in the present invention, and actual examples have been disclosed in the patents cited in the aforementioned *Research Disclosure*, No. 17643, sections VII-C-G.

Those disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,064, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and WO (PCT) 88/04795 are especially desirable.

Phenol and naphthol based couplers can be used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (Laid Open) 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Colored couplers for correcting the unwanted absorptions of colored dyes, as disclosed, for example, in section VII-G of *Research Disclosure*, No. 17643, U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181 and couplers which have, as leaving groups, dye precursors which can form dyes on reaction with a developing agent as disclosed in U.S. Pat. No. 4,777,120 is also desirable.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

Typical examples of polymerized dye forming couplers have been disclosed, for example, in U.S. Pat. Nos. 3,451,820, 4,080,211, 4,367,282, 4,409,320 and 4,576,910, and British Patent 2,102,173.

The use of couplers which release photographically useful residual groups on coupling is preferred in the present invention. The DIR couplers which release developing inhibitors disclosed in the patents cited in section VII-F of the aforementioned *Research Disclosure*, No. 17643, JP-A-57-151944, JP-A-57-154234, JP-A-60-184248, JP-A-63-37346 and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in the form of the image during development.

Other couplers which can be used in photosensitive materials of the present invention include the competitive couplers disclosed, for example, in U.S. Pat. No. 4,130,427, the multiequivalent couplers disclosed, for example, in U.S. Pat. Nos. 4,283,472, 4,338,393 and 4,310,618, the DIR redox compound releasing couplers, DIR couplers releasing couplers, DIR coupler releasing redox compounds or DIR redox releasing redox compounds disclosed, for example, in JP-A-60-185950 and JP-A-62-24252, the couplers which release dyes of which the color is restored after elimination as disclosed, for example, in European Patent 173,302A, the bleach accelerator releasing couplers disclosed, for example, in *Research Disclosure*, Nos. 11449 and 24241, and JP-A-61-201247, the ligand releasing couplers disclosed, for example, in U.S. Pat. No. 4,553,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using a variety of known methods of dispersion.

Examples of high boiling point solvents which can be used in the oil-in-water dispersion method have been disclosed, for example, in U.S. Pat. No. 2,322,027.

Actual examples of high boiling point organic solvents which have a boiling point of at least 175° C. at normal pressure which can be used in the oil-in-water dispersion method include phthalic acid esters (for example, dibutyl phthalate, dicyclohexyl phthalate, di-2-ethylhexyl phthalate, decyl phthalate, bis(2,4-ditert-amylphenyl)phthalate, bis(2,4-di-tert-amylphenyl-)isophthalate and bis(1,1-diethylpropyl)phthalate), phosphate or phosphonate esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxy benzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl)sebacate, dioctyl azelate, glycerol tributyrate, isostearyl lactate and trioctyl citrate), aniline derivatives (for example, N,N-dibutyl-2-butoxy-5-tertoctylaniline) and hydrocarbons (for example, paraffins, dodecylbenzene and diisopropylnaphthalene). Furthermore, organic solvents which have a boiling point above about 30° C., and preferably of at least 50° C. but below about 160° C., can be used as auxiliary solvents, and typical examples of these solvents include ethyl acetate, butyl acetate, ethyl propionate, methyl ethyl ketone, cyclohexanone, 2-ethoxyethyl acetate and dimethylformamide.

Actual examples of the processes and effects of the latex dispersion method and of latexes for loading purposes have been disclosed, for example, in U.S. Pat. No. 4,199,363 and West German Patent Application (OLS) Nos. 2,541,274 and 2,541,230.

The present invention can be applied to various types of color photosensitive materials. Typical examples include color negative films for general or cinematographic purposes, color reversal films for slides or video purposes, color papers, color positive films and color reversal papers.

Suitable supports which can be used in the present invention have been disclosed, for example, on page 28 of the aforementioned *Research Disclosure*, No. 17643, and from the right hand column of page 647 to the left hand column of page 648 of *Research Disclosure*, No. 18716.

The photosensitive materials of the present invention are preferably such that the total film thickness of all the hydrophilic colloid layers on the side where the emulsion layers are located is not more than 28 μm, and the film swelling rate ($T_{\frac{1}{2}}$) is not more than 30 seconds. The film thickness signifies the film thickness measured at 25° C., 55% relative humidity (2 days), and the film swelling rate ($T_{\frac{1}{2}}$) can be measured using methods well known to those in the industry. For example, measurements can be made using a swellometer of the type described by A. Green in *Photogr. Sci. Eng.*, Vol. 19, No. 2, pages 124–129, and $T_{\frac{1}{2}}$ is defined as the time taken for obtaining the half of the saturated film thickness, which thickness is defined as 90% of the maximum swollen film thickness reached on processing the material for 3 minutes 15 seconds in a color developing bath at 30° C.

The film swelling rate ($T_{\frac{1}{2}}$) can be adjusted by adding film hardening agents for the gelatin which is used as a binder, or by changing the aging conditions after coating. Furthermore, the swelling factor is preferably from 150% to 400%. The swelling factor can be calculated from the maximum swollen film thickness obtained under the conditions described above using the expression (maximum swollen film thickness − film thickness)/film thickness.

The color photographic photosensitive materials to which the present invention applies can be developed and processed in the usual way as disclosed on pages 28 and 29 of the aforementioned *Research Disclosure*, No. 17643 and from the left hand column to the right hand column of page 615 of the aforementioned *Research Disclosure*, No. 18716.

The color development baths used in the development processing of photosensitive materials of the present invention are preferably aqueous alkaline solutions which contain a primary aromatic amine based color developing agent as the principal component. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, according to the intended purpose.

The color development baths generally contain pH buffers such as alkali metal carbonates, borates or phosphates, and development inhibitors or antifoggants such as bromides, iodides, benzimidazoles, benzothiazoles or mercapto compounds. They may also contain, as required, various preservatives such as hydroxylamine, diethylhydroxylamine, sulfites, hydrazines, phenylsemicarbazides, triethanolamine, catecholsulfonic acids and triethylenediamine(1,4-diazabicyclo[2,2,2]octane) compounds, organic solvents such as ethylene glycol and diethylene glycol, development accelerators such as benzyl alcohol, polyethylene glycol, quaternary ammonium salts and amines, dye forming couplers, competitive couplers, fogging agents such as sodium borohydride, auxiliary developing agents such as 1-phenyl-3-pyrazolidone, viscosity increasing agents, and various chelating agents as typified by the aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediaminedi(o-hydroxyphenylacetic acid) and salts of these acids.

Color development is carried out after a normal black-and-white development in cases where reversal processing is carried out. The known black-and-white developers, for example, dihydroxybenzenes such as hydroquinone, 3-pyrazolidones such as 1-phenyl-3-pyrazolidone, or aminophenols such as N-methyl-p-aminophenol, can be used individually, or in combinations, in the black-and-white development baths.

The pH value of these color development baths and black-and-white development baths is generally from 9 to 12. The replenishment rate of these development baths depends on the color photographic material which is being processed, but it is generally not more than 3 liters per square meter of color photographic material, and it can be set below 500 ml per square meter of photographic material by reducing the bromide ion concentration in the replenisher. Prevention of liquid evaporation and aerial oxidation of the bath by reducing the area of contact with the air in the processing tank is desirable in those cases where the replenishment rate has been reduced. Furthermore, the replenishment rate can be further reduced by adopting some means of suppressing the accumulation of bromide ion in the development bath.

The color development processing time is normally set within the range from 2 to 5 minutes, but it is possible to arrange shorter processing times by using high temperatures and high pH levels, and by increasing the concentration of the color developing agent.

The photographic emulsion layer is subjected to a normal bleaching process after color development. The bleaching process may be carried out at the same time as a fixing process (in a bleach-fix process) or it may be carried out as a separate process. Moreover, a bleach-fix process can be carried out after a bleaching process in order to speed up processing. Moreover, a bleach-fixing process can be carried out in two connected bleach-fix baths, a fixing process can be carried out before a bleach-fixing process or a bleaching process can be carried out after a bleach-fix process. Compounds of multivalent metals, such as iron(III), cobalt(III), chromium(IV) and copper(II), peracids, quinones and nitro compounds, for example, can be used as bleaching agents. Typical bleaching agents include ferricyanides; dichromates; organic complex salts of iron(III) or cobalt(III), for example, complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or citric acid, tartaric acid or malic acid; persulfates; permanganates; and nitrobenzenes. From among these materials, the use of the polyaminocarboxylic acid iron(III) complex salts, principally ethylenediaminetetraacetic acid iron(III) complex salts, and persulfates, is preferred from the points of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is normally from 5.5 to 8, but lower pH values can be used in order to speed up processing.

Bleaching accelerators can be used, as required, in the bleach baths, bleach-fix baths or bleach or bleach-fix prebaths. Actual examples of useful bleach accelerators have been disclosed in the following specifications: Thus, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (June, 1978); the thiazolidine compounds disclosed in JP-A-50-140129; the thiourea compounds disclosed in JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleach accelerators may also be added to the sensitive materials. These bleach accelerators are especially effective when bleach-fixing camera color photosensitive materials.

Thiosulfates, thiocyanates, thioether based compounds, thioureas and large amounts of iodide can be used, for example, as fixing agents, but thiosulfates are normally used, and ammonium thiosulfate in particular can be used in the widest range of application. Sulfites, bisulfites or carbonyl/bisulfite addition compounds are preferred as preservatives for bleach-fix baths.

The silver halide color photographic materials of the present invention are usually subjected to a water washing process and/or stabilization process after the desilvering process. The amount of wash water used in the washing process can be fixed within a wide range, depending on the application and the nature (for example, the materials such as couplers which have been used) of the photosensitive material, the wash water temperature, the number of water washing tanks (the number of water washing stages) and the replenishment system, i.e., whether a countercurrent flow or a cocurrent sequential flow system is used, and various other conditions. The relationship between the amount of water used and the number of washing tanks in a multistage countercurrent flow system can be obtained using the method outlined on pages 248–253 of the *Journal of the Society of Motion Picture and Television Engineers.* Vol. 64, (May, 1955).

The amount of wash water can be greatly reduced by using the multistage countercurrent flow system noted in the aforementioned literature, but bacteria proliferate due to the increased residence time of the water in the tanks, and problems arise with the suspended matter which is produced becoming attached to the photosensitive material. The method in which the calcium ion and magnesium ion concentrations are reduced, as disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in "The Chemistry of Biocides and Fungicides" by Horiguchi, in *Killing Microorganisms, Biocidal and Fungicidal Techniques* published by the Health and Hygiene Technology Society, and in *A Dictionary of Biocides and Fungicides* published by the Japanese Biocide and Fungicide Society, can also be used in this connection.

The pH value of the water wash water when processing photosensitive materials of the present invention is from 4 to 9, and preferably from 5 to 8. The washing water temperature and the washing time can be set variously in accordance with the nature and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of the present invention can be processed directly in a stabilizing bath instead of being subjected to a water wash as described above. The known methods disclosed in JP-A-57-8543, JP-A-58-14834 and JP-A-60-220345 can be used for this purpose.

Furthermore, in some cases a stabilization process is carried out following the aforementioned water washing process, and the stabilizing baths which contain formalin and surfactant which are used as final baths with camera color photosensitive materials are an example of such a process. Various chelating agents and fungicides can also be added to these stabilizing baths.

The overflow which accompanies replenishment of the above mentioned water washing or stabilizing baths can be reused in other processes, such as the desilvering process, for example.

Color developing agents can be incorporated into a silver halide color photosensitive material of the present invention with a view to simplifying and speeding up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599 and *Research Disclosure,* Nos. 14850 and 15159, the aldol compounds disclosed in *Research Disclosure,* No. 13924, the metal complex salts disclosed in U.S. Pat. No. 3,719,492 and the urethane based compounds disclosed in JP-A-53-135628 can be used for this purpose.

Various 1-phenyl-3-pyrazolidones can also be incorporated, as required, into the silver halide color photosensitive materials of the present invention with a view to accelerating color development. Typical compounds of this type have been disclosed, for example, in JP-A-56-64339, JP-A-57-144547 and JP-A-58-115438.

The various processing baths in the present invention are used at a temperature of from 10° C. to 50° C. The standard temperature is normally from 33° C. to 38° C., but accelerated processing and shorter processing times can be realized at higher temperatures while, on the other hand, increased picture quality and better processing bath stability can be achieved at lower temperatures. Furthermore, processes using hydrogen peroxide intensification or cobalt intensification as disclosed in West German Patent 2,226,770 or U.S. Pat. No. 3,674,499 can be used in order to economize on silver in the photosensitive material.

Furthermore, the silver halide photosensitive material of the present invention can also be used in the heat developable photosensitive materials disclosed, for example, in U.S. Pat. No. 4,500,626, JP-A-60-133449, JP-A-59-218443, JP-A-61-238056 and European Patent 210,660A2.

The following examples are intended to illustrate the present invention in more detail but should not be construed as limiting it in any way.

EXAMPLE 1

Emulsions (1) to (20) containing Couplers (A-18), (A-17) or (A-11) of the present invention as shown in Table 1 under the heading "Second Layer" were prepared by heating to form an oil phase solution and an aqueous phase solution as described below, and then mixing these phases and emulsifying and dispersing for 10 minutes in a home mixer.

| | |
|---|---|
| Oil Phase | |
| Coupler of the Present Invention | 30 g |
| Ultraviolet Absorber of the Present Invention | 0 or 6 g |
| Solv-1 | 0, 6, 12 or 30 g |
| Ethyl Acetate | 70 g |
| Aqueous Phase | |
| Sodium Dodecylbenzenesulfonate | 1 g |
| Bovine Gelatin | 50 g |
| Water to make | 636 g |

500 g of Emulsions (1) to (20) was mixed with 700 g of a silver iodobromide emulsion (AgI content 10 mol %, average grain size 0.3 μm, potato like grains, 7 wt % gelatin, 7 wt % as silver) which had been chemically sensitized and spectrally sensitized with anhydro-5,5'-dichloro-9-ethyl-3,3'-di(3-sulfopropyl)thiacarbocyanine hydroxide and anhydro-9-ethyl-3,3'-di(3-sulfopropyl)-4,5,4',5'-dibenzothiacarbocyanine hydroxide, after which 0.01 g of 4-hydroxy-6-methyl-1,3,3a,7-tetraazaindene was added. The liquids so obtained were then used for the emulsion layers when preparing Photosensitive Materials 101 to 120 as indicated below using Emulsions (1) to (20).

| | |
|---|---|
| First Layer: Underlayer | |
| Gelatin | 1.0 g/m² |
| Ultraviolet Absorber | 0 or 0.135 g/m² |
| Solv-2 | 0.2 g/m² |
| Second Layer: Emulsion Layer | |
| Each One of Emulsions (1) to (20) | 1.4 g/m² as silver |
| Coupler of the Present Invention | 0.674 g/m² |
| Ultraviolet Absorber | 0 or 0.135 g/m² |
| Solv-1 | 0, 0.135, 0.270 or 0.674 g/m² |
| Gelatin | 2.5 g/m² |

-continued

| | |
|---|---|
| Third Layer: Protective Layer | |
| Gelatin | 1.0 g/m² |
| Poly(methyl methacrylate) Particles (diameter: 1.5 μm) | 0.03 g/m² |
| Ultraviolet Absorber | 0 or 0.135 g/m² |
| Solv-1 | 0.1 g/m² |
| H-1 | 0.15 g/m² |

These photosensitive materials were subjected to a sensitometric exposure and then they were developed and processed at 35° C. in the following way:

| | |
|---|---|
| 1. Color Development | 3 min 15 sec |
| 2. Bleach | 6 min 30 sec |
| 3. Water Wash | 3 min 15 sec |
| 4. Fix | 4 min 20 sec |
| 5. Water Wash | 3 min 15 sec |
| 6. Stabilization | 1 min 5 sec |

The processing baths used for each process are described below.

| | |
|---|---|
| Color Development Bath: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 liter |
| Bleach Bath: | |
| Ammonium Bromide | 160.0 g |
| Aqueous Ammonia (28%) | 25.0 cc |
| Ethylenediaminetetraacetic Acid, Sodium Iron Salt | 130.0 g |
| Glacial Acetic Acid | 14.0 cc |
| Water to make | 1 liter |
| Fixer Bath: | |
| Sodium Tetrapolyphosphate | 2.0 g |
| Sodium Sulfite | 4.0 g |
| Ammonium Thiosulfate (70%) | 175.0 cc |
| Sodium Hydrogenphosphite | 4.6 g |
| Water to make | 1 liter |
| Stabilizer Bath: | |
| Formalin | 8.0 cc |
| Water to make | 1 liter |

The processed samples obtained in the way described above were exposed for 7 days from the first layer (support) side and from the third layer side in a fluorescent lamp color fading tester (10,000 lux) and the increase in the yellow density of the samples in the unexposed parts is shown in Table 1 as the yellow staining ($\Delta D_B$).

The above mentioned photosensitive materials were also stored for 14 days at room temperature and at −25° C., after which they were developed in the way described above, the maximum cyan density was measured and the fall in cyan density from that of the sample stored at room temperature to that of the sample stored at −25° C. is shown as in Table 1.

Moreover, Emulsions (1) to (20) were stored for 14 days in a refrigerator at 2° C., after which they were mixed with silver halide emulsion in the same way as before and coated after storage with agitation for 6 hours at 40° C. in the same way as when preparing Photosensitive Materials 101 to 120 and the coated state of the samples is shown in Table 1 as a measure of the coating properties.

TABLE 1

| Sample | UV Absorber in the First Layer | UV Absorber in the Third Layer | Second Layer Coupler | Second Layer Weight[1] Ratio | Second Layer UV Absorber | $\Delta D_B$[2] First Layer Side | $\Delta D_B$[2] Third Layer Side | $\Delta D_R$[3] | Coating Properties after Storing the Emulsion at Low Temperature and Aging the Coating Liquid |
|---|---|---|---|---|---|---|---|---|---|
| 101 (Invention) | None | None | (A-18) | 0 | UV-6 | 0.02 | 0.02 | 0.00 | Good |
| 102 (Invention) | None | None | (A-18) | 0.2 | UV-6 | 0.03 | 0.03 | 0.00 | Good |
| 103 (Comparison) | None | None | (A-18) | 0.4 | UV-6 | 0.04 | 0.04 | 0.00 | Good |
| 104 (Comparison) | None | None | (A-18) | 1.0 | UV-6 | 0.04 | 0.04 | 0.00 | Good |
| 105 (Comparison)[6] | None | None | (A-18) | 0 | None | 0.10 | 0.11 | −0.12 | Irregular |
| 106 (Comparison)[6] | None | None | (A-18) | 0.2 | None | 0.12 | 0.13 | −0.09 | Irregular |
| 107 (Comparison) | None | None | (A-18) | 1.0 | None | 0.14 | 0.16 | −0.03 | Slightly irregular |
| 108 (Comparison) | None | None | (A-18) | 1.0 | None | 0.16 | 0.18 | −0.01 | Good |
| 109 (Invention) | None | None | (A-18) | 1.0 | UV-1 | 0.03 | 0.03 | 0.00 | Good |
| 110 (Invention) | None | None | (A-18) | 1.0 | UV-3 | 0.03 | 0.03 | −0.01 | Good |
| 111 (Invention) | None | None | (A-18) | 1.0 | UV-4 | 0.03 | 0.03 | 0.00 | Good |
| 112 (Invention) | None | None | (A-18) | 1.0 | UV-5 | 0.03 | 0.03 | −0.01 | Good |
| 113 (Invention) | None | None | (A-18) | 1.0 | UV-1/UV-6[4] | 0.02 | 0.02 | 0.00 | Good |
| 114 (Invention) | None | None | (A-18) | 1.0 | UV-3/UV-6[4] | 0.02 | 0.02 | 0.00 | Good |
| 115 (Invention) | None | None | (A-17) | 1.0 | UV-3 | 0.03 | 0.03 | 0.00 | Good |
| 116 (Comparison) | None | None | (A-17) | 1.0 | None | 0.13 | 0.11 | −0.11 | Irregular |
| 117 (Invention) | None | None | (A-11) | 1.0 | UV-6 | 0.04 | 0.04 | −0.02 | Good |
| 118 (Comparison) | None | None | (A-11) | 1.0 | None | 0.13 | 0.11 | −0.15 | Irregular |
| 119 (Comparison)[5] | None | UV-15 | (A-18) | 1.0 | None | 0.16 | 0.03 | −0.13 | Irregular |
| 120 (Comparison)[6] | UV-15 | None | (A-18) | 0.2 | None | 0.03 | 0.14 | −0.12 | Irregular |

[1]Solv-1 (high boiling point organic solvent)/coupler ratio, in which 0, 0.2, 0.4 and 1.0 mean that the amounts of Solv-1 are 0, 0.135, 0.270 and 0.674 g/m², respectively
[2]Yellow staining density difference
[3]Cyan density reduction on storing 14 days at −25° C.
[4]UV-1/UV-6 and UV-3/UV-6 were 1 to 1 by weight mixtures, 0.135 g/m²
[5]The photographic material having the same combination as disclosed in illustrative Example 2 of JP-A-62-35356
[6]The photographic material suggested in JP-A-62-269958

It is clear from Table 1 that the samples of the present invention exhibited no loss of cyan density even after storage at the very low temperature of −25° C., that the increase in yellow staining due to irradiation of the developed samples with fluorescent light was small, and that the coating properties were good even when the emulsions had been aged under refrigeration and the coating liquids had been aged.

EXAMPLE 2

Sample 201, a multilayer color photosensitive material comprised of each of the layers of which the compositions are indicated below was prepared on a cellulose triacetate film support on which an underlayer had been established.

Preparation of the Photosensitive Layer

The coated weights of the silver halides and colloidal silver are shown in units of grams Ag/m², the coated weights of the couplers, additives and gelatin are shown in units of g/m², and the coated weights of sensitizing dyes are shown in terms of the number of mols per mol of silver halide in the same layer.

| | |
|---|---|
| First Layer: Antihalation Layer | |
| Black Colloidal Silver | 0.2 |
| Gelatin | 1.3 |
| ExM-8 | 0.06 |
| UV-1 | 0.1 |
| UV-3 | 0.1 |
| UV-6 | 0.1 |
| Solv-1 | 0.01 |
| Solv-2 | 0.01 |
| Second Layer: Intermediate Layer | |
| Fine Grained Silver Bromide (average grain size 0.07 μm) | 0.10 |
| Gelatin | 1.5 |
| UV-1 | 0.06 |

-continued

| | |
|---|---|
| UV-3 | 0.06 |
| UV-6 | 0.06 |
| ExC-2 | 0.02 |
| ExF-1 | 0.004 |
| Solv-1 | 0.1 |
| Solv-2 | 0.09 |
| Third Layer: First Red Sensitive Emulsion Layer | |
| Silver Iodobromide Emulsion (2 mol % AgI, high internal AgI type, corresponding sphere diameter 0.3 μm, variation coefficient of the corresponding sphere diameter 29%, regular crystal, twinned crystal mixed grains, diameter/thickness ratio 2.5) | |
| Coated weight as silver | 0.4 |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| Coupler (A-18) of the Present Invention | 0.25 |
| ExC-7 | 0.04 |
| ExC-2 | 0.03 |
| Solv-2 | 0.20 |
| Fourth Layer: Second Red Sensitive Emulsion Layer | |
| Silver Iodobromide Emulsion (5 mol % AgI, high internal AgI type, corresponding sphere diameter 0.7 μm, variation coefficient of the corresponding sphere diameter 25%, regular crystal, twinned crystal mixed grains, diameter/thickness ratio 4) | |
| Coated weight as silver | 0.7 |
| Gelatin | 0.8 |
| ExS-1 | $1 \times 10^{-4}$ |
| ExS-2 | $3 \times 10^{-4}$ |
| ExS-3 | $1 \times 10^{-5}$ |
| Coupler (A-18) of the Present Invention | 0.35 |
| ExC-17 | 0.02 |
| ExC-2 | 0.04 |
| Solv-3 | 0.28 |
| Fifth Layer: Third Red Sensitive Emulsion Layer | |
| Silver Iodobromide Emulsion (10 mol % AgI, high internal AgI type, corresponding sphere diameter 0.8 μm, variation coefficient of the | |

-continued

| | |
|---|---|
| corresponding sphere diameter 16%, regular crystal, twinned crystal mixed grains, diameter/thickness ratio 1.3) | |
| Coated weight as silver | 1.0 |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-3 | 0.05 |
| ExC-4 | 0.05 |
| ExC-17 | 0.0005 |
| ExC-7 | 0.0005 |
| Solv-1 | 0.01 |
| Solv-2 | 0.05 |
| Sixth Layer: Intermediate Layer | |
| Gelatin | 1.0 |
| Cpd-1 | 0.03 |
| Solv-1 | 0.05 |
| Seventh Layer: First Green Sensitive Emulsion Layer | |
| Silver Iodobromide Emulsion (2 mol % AgI, high internal AgI type, corresponding sphere diameter 0.3 μmm variation coefficient of the corresponding sphere diameter 28%, regular crystal, twinned crystal mixed grains, diameter/thickness ratio 2.5) | |
| Coated weight as silver | 0.30 |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| Eighth Layer: Second Green Sensitive Emulsion Layer | |
| Silver Iodobromide Emulsion (4 mol % AgI, high internal AgI type, corresponding sphere diameter 0.6 μm, variation coefficient of the corresponding sphere diameter 38%, regular crystal, twinned crystal mixed grains, diameter/thickness ratio 4) | |
| Coated weight as silver | 0.4 |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-6 | 0.25 |
| ExM-8 | 0.03 |
| ExM-10 | 0.015 |
| ExY-14 | 0.01 |
| Solv-1 | 0.2 |
| Ninth Layer: Third Green Sensitive Emulsion Layer | |
| Silver Iodobromide Emulsion (6 mol % AgI, high internal AgI type, corresponding sphere diameter 1.0 μm, variation coefficient of the corresponding sphere diameter 80%, regular crystal, twinned crystal mixed grains, diameter/thickness ratio 1.2) | |
| Coated weight as silver | 0.85 |
| Gelatin | 1.0 |
| ExS-7 | $3.5 \times 10^{-4}$ |
| ExS-8 | $1.4 \times 10^{-4}$ |
| ExM-6 | 0.01 |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| Tenth Layer: Yellow Filter Layer | |
| Gelatin | 1.2 |
| Yellow Colloidal Silver | 0.08 |
| Cpd-2 | 0.1 |
| Solv-1 | 0.3 |
| Eleventh Layer: First Blue Sensitive Emulsion Layer | |
| Silver Iodobromide Emulsion (4 mol % AgI, high internal AgI type, corresponding sphere diameter 0.5 μm, variation coefficient of the corresponding sphere diameter 15%, octahedral grains) | |
| Coated weight as silver | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |
| Twelfth Layer: Second Blue Sensitive Emulsion Layer | |
| Silver Iodobromide Emulsion (10 mol % AgI, high internal AgI type, corresponding sphere diameter 1.3 μm, variation coefficient of the corresponding sphere diameter 25%, regular crystal, twinned crystal mixed grains, diameter/thickness ratio 4.5) | |
| Coated weight as silver | 0.5 |
| Gelatin | 0.6 |
| ExS-9 | $1 \times 10^{-4}$ |
| ExY-16 | 0.25 |
| Solv-1 | 0.07 |
| Thirteenth Layer: First Protective Layer | |
| Gelatin | 0.8 |
| UV-10 | 0.1 |
| UV-7 | 0.2 |
| Solv-1 | 0.01 |
| Solv-2 | 0.01 |
| Fourteenth Layer: Second Protective Layer | |
| Fine Grained Silver Bromide (average grain size 0.07 μm) | 0.5 |
| Gelatin | 0.45 |
| Poly(methyl methacrylate) Particles (diameter 1.5 μm) | 0.2 |
| H-1 | 0.4 |
| Cpd-3 | 0.5 |
| Cpd-4 | 0.5 |

Surfactant was added to each layer as a coating promotor in addition to the components indicated above. The sample prepared in this way was Sample 201.

Samples 202 to 217 were prepared by varying the types and amounts of the couplers and the amounts of Solv-1 and Solv-2 in the third and fourth layers of Sample 201 in the way indicated in Table 2 below, and by adding an ultraviolet absorber of the present invention at a rate of from 0 to 0.03 in terms of the ratio by weight with respect to the coupler.

These Photosensitive Materials 201 to 217 were stored either (1) for 7 days at 7° C. or (2) for 7 days at −20° C., after which the samples were left to stand for 3 hours at 25° C. and then they were given a sensitometric exposure and color developed and processed, the cyan image densities were measured and the cyan density ($D_R$) of the sample stored at −20° C. when exposed at the exposure which gave a cyan density of 200 with the sample stored at 7° C. was measured with the results shown in Table 2.

Furthermore, cuts were made with a knife from the emulsion surface so as to reach through to the support in the developed samples which had been stored at 7° C., commercial cellophane tape was stuck over the emulsion side surface and the tape was pulled away. Film peeling occurred in this test with some of the samples. With other samples, the tape peeled off without peeling away the film. The results obtained in this test are summarized in Table 2.

The color development processing was carried out at 38° C. using the processing operations indicated below.

| | |
|---|---|
| 1. Color Development | 3 min 15 sec |
| 2. Bleach | 6 min 30 sec |
| 3. Water Wash | 2 min 10 sec |
| 4. Fix | 4 min 20 sec |
| 5. Water Wash | 3 min 15 sec |
| 6. Stabilization | 1 min 05 sec |

The processing baths used for each process are described below.

| | |
|---|---|
| Color Development Bath: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1 liter |
| pH | 10.0 |
| Bleach Bath: | |
| Ethylenediaminetetraacetic Acid, Ferric Ammonium Salt | 100.0 g |
| Ethylenediaminetetraacetic Acid, Disodium Salt | 10.0 g |
| Ammonium Bromide | 150.0 g |
| Ammonium Nitrate | 10.0 g |
| Water to make | 1 liter |
| pH | 6.0 |
| Fixer Bath: | |
| Ethylenediaminetetraacetic Acid, Disodium Salt | 1.0 g |
| Sodium Sulfite | 4.0 g |
| Aqueous Ammonium Thiosulfate Solution (70%) | 175.0 ml |
| Sodium Bisulfite | 4.6 g |
| Water to make | 1 liter |
| pH | 6.6 |
| Stabilizer Bath: | |
| Formalin (40%) | 2.0 ml |
| Polyoxyethylene-p-monomonylphenyl Ether (average degree of polymerization 10) | 0.3 g |
| Water to make | 1 liter |

TABLE 2

| | Third Layer | | | | Fourth Layer | | | | | |
|---|---|---|---|---|---|---|---|---|---|---|
| Sample | Coupler | Solv-2/ Coupler | UV Absorber | Ratio by Weight of UV Absorber to Coupler | Coupler | Solv-1/ Coupler | UV Absorber | Ratio by Weight of UV Absorber to Coupler | $D_R$[1] | Cut Durability |
| 201 (Comparison) | (A-18) | 0.8 | — | 0 | (A-18) | 0.8 | — | 0 | 2.00 | Much film peeling |
| 202 (Comparison) | (A-18) | 0.2 | — | 0 | (A-18) | 0.2 | — | 0 | 1.91 | Good |
| 203 (Comparison) | (A-18) | 0.1 | — | 0 | (A-18) | 0.1 | — | 0 | 1.88 | Good |
| 204 (Comparison) | (A-18) | 0 | — | 0 | (A-18) | 0 | — | 0 | 1.85 | Good |
| 205 (Comparison) | (A-18) | 0.8 | UV-4 | 0.2 | (A-18) | 0.8 | UV-4 | 0.3 | 2.00 | Much film peeling |
| 206 (Invention) | (A-18) | 0.2 | UV-4 | 0.2 | (A-18) | 0.2 | UV-4 | 0.3 | 2.01 | Good |
| 207 (Invention) | (A-18) | 0.1 | UV-4 | 0.2 | (A-18) | 0.1 | UV-4 | 0.3 | 2.00 | Good |
| 208 (Invention) | (A-18) | 0 | UV-4 | 0.2 | (A-18) | 0 | UV-4 | 0.3 | 1.99 | Good |
| 209 (Comparison) | (A-18) | 0 | UV-4 | 0.04 | (A-18) | 0 | UV-4 | 0.04 | 1.89 | Good |
| 210 (Invention) | (A-18) | 0 | UV-4 | 0.1 | (A-18) | 0 | UV-4 | 0.15 | 1.99 | Good |
| 211 (Invention) | (A-18) | 0 | UV-4/ UV-6[2] | 0.2 | (A-18) | 0 | UV-4/ UV-6[2] | 0.2 | 2.00 | Good |
| 212 (Invention) | (A-18) | 0 | UV-1/ UV-4/ UV-6[3] | 0.2 | (A-18) | 0 | UV-1/ UV-4/ UV-6[3] | 0.2 | 2.00 | Good |
| 213 (Invention) | (A-18)/ (A-12)[4] | 0 | UV-4 | 0.2 | (A-18)/ (A-12)[5] | 0 | UV-4 | 0.2 | 2.01 | Good |
| 214 (Invention) | (A-18)/ (A-17)[4] | 0 | UV-4 | 0.2 | (A-18)/ (A-17)[5] | 0 | UV-4 | 0.2 | 2.00 | Good |
| 215 (Invention) | (A-18)/ (A-17)[4] | 0 | UV-4 | 0.2 | (A-18)/ (A-17)[4] | 0 | UV-4 | 0.2 | 2.00 | Good |
| 216 (Invention) | (A-12) | 0 | UV-4/ UV-6[2] | 0.3 | (A-12) | 0 | UV-4/ UV-6[2] | 0.3 | 2.00 | Good |
| 217 (Comparison) | (A-12) | 0 | — | 0 | (A-12) | 0 | — | 0 | 1.87 | Good |

[1]Cyan density of sample stored at −20° C. with exposure which gave a cyan density of 2.0 with a sample stored at 7° C.
[2]Mixture of two UV absorbers (mixing weight ratio 1/1)
[3]Mixture of three types of UV absorber (mixing weight ratio 1/1/1)
[4]Mixture of two types of coupler (mixing weight ratio 2/1)
[5]Mixture of two types of coupler (mixing weight ratio 3/1)

It is clear from Table 2 that the photosensitive materials of the present invention exhibit virtually no reduction in cyan density even after storage at low temperatures of −20° C., and that the film strength is good.

The chemical structure or the chemical name of each of the compounds used in these examples are shown below.

Tricresyl phosphate Solv-1
Dibutyl phthalate Solv-2
Bis(2-ethylhexyl)phthalate Solv-3
ExM-8
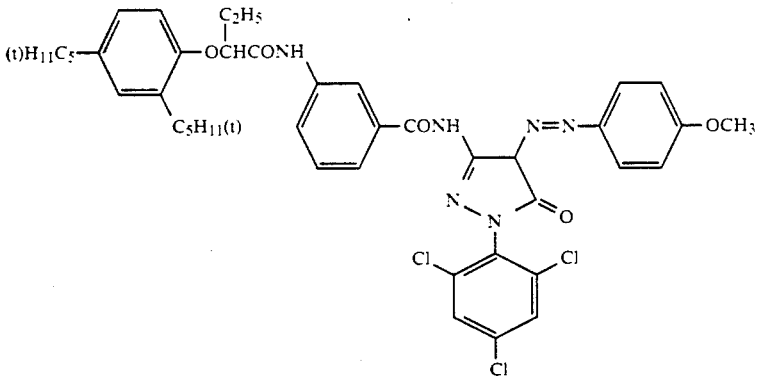
ExF-1
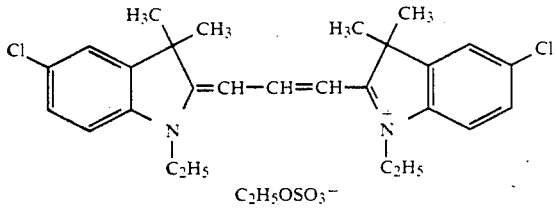
ExC-2
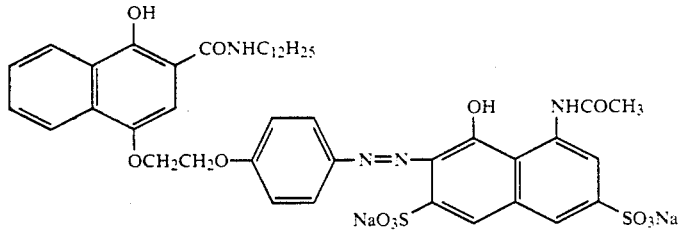
ExC-3
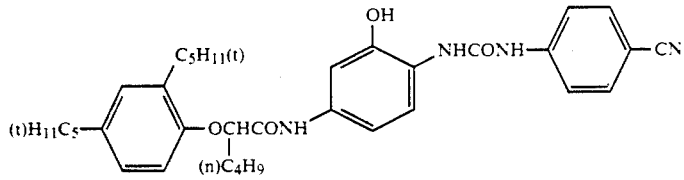
ExC-4
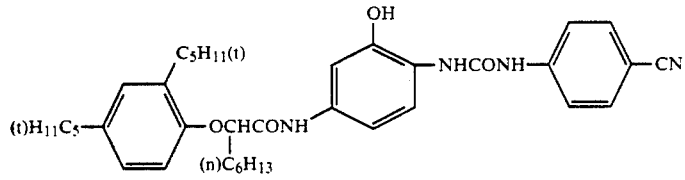
ExY-14
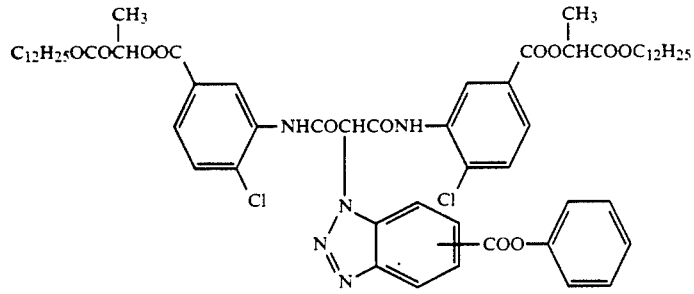

-continued
ExY-15
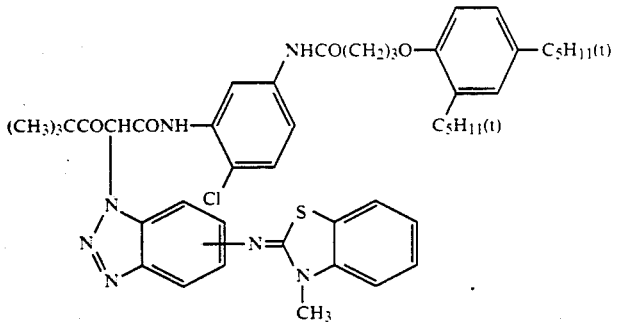
ExC-5
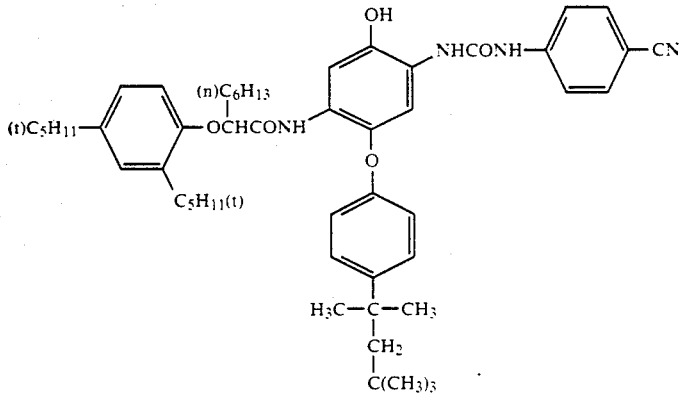
ExM-6
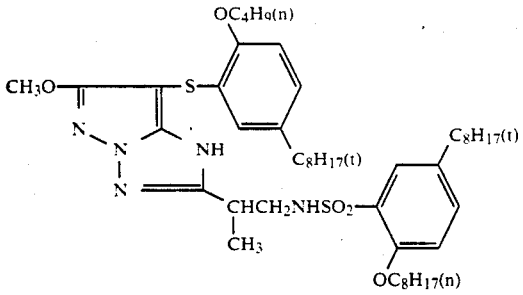
ExC-7
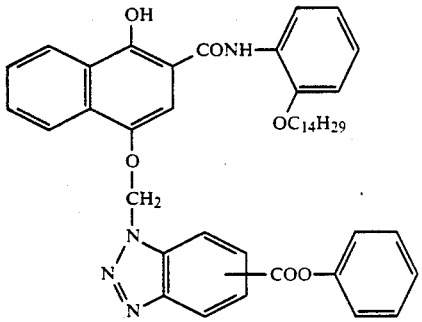

-continued
ExM-9
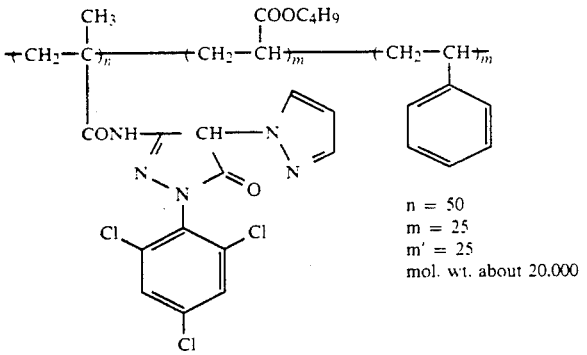
n = 50
m = 25
m' = 25
mol. wt. about 20,000
ExM-10
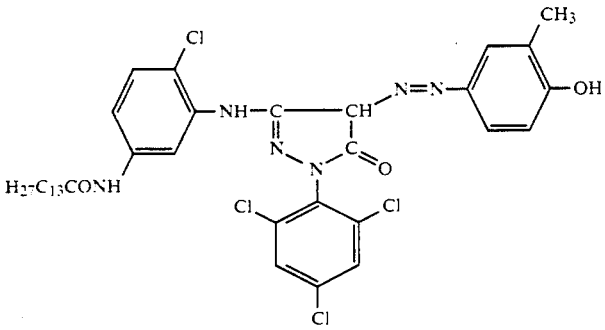
ExM-11
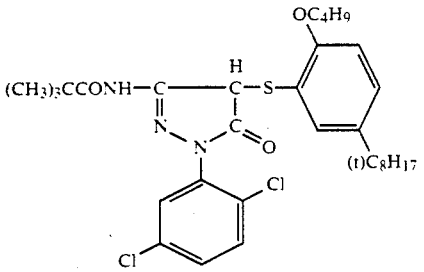
ExM-12
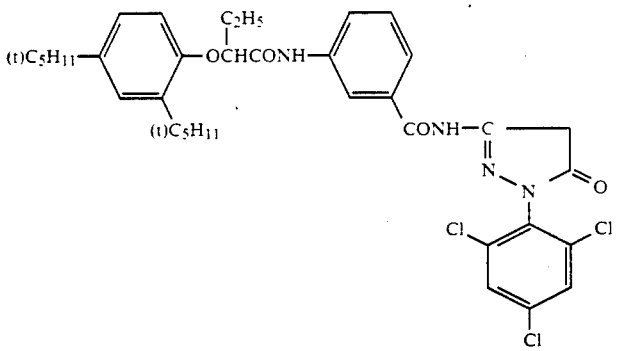
ExM-13
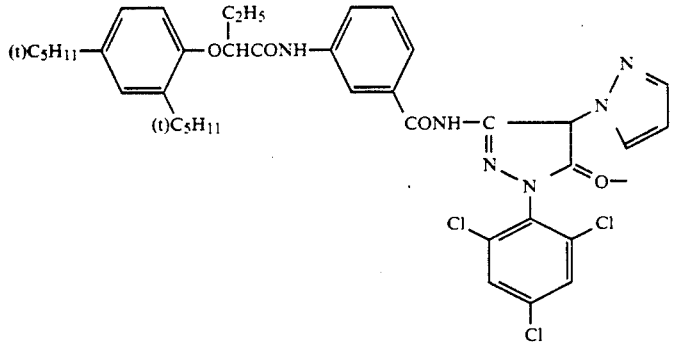

-continued
ExY-16
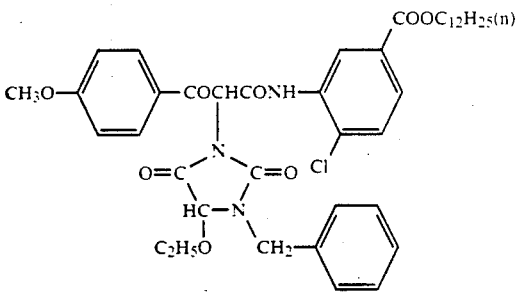
ExC-17
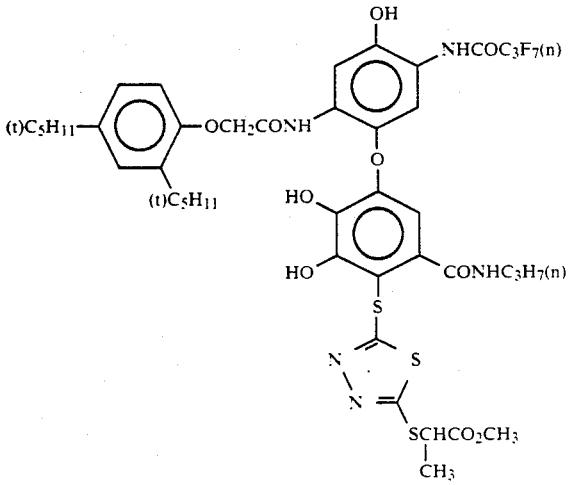
Cpd-1
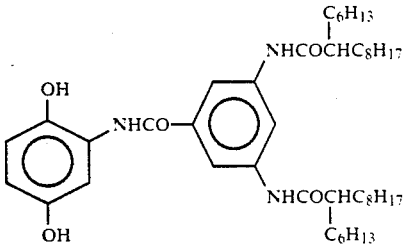
Cpd-2
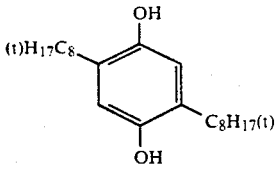
ExS-1
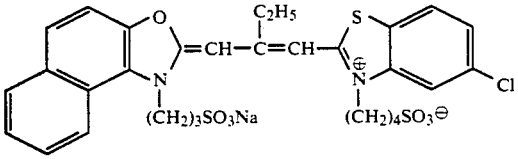
ExS-2
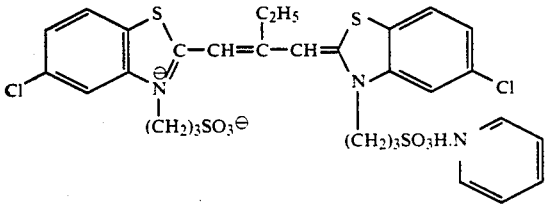

-continued
ExS-3
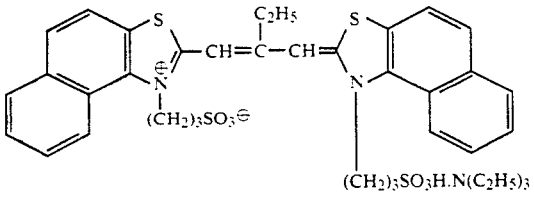
ExS-4
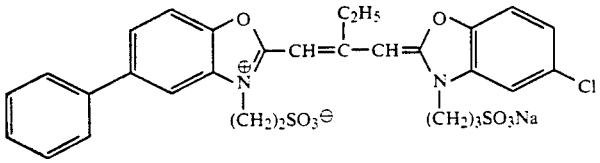
ExS-5
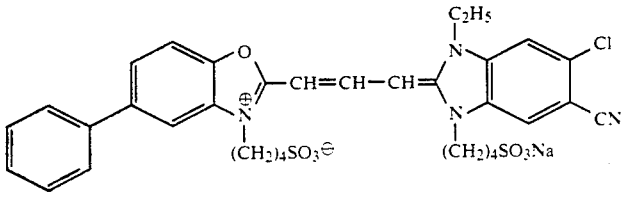
ExS-6
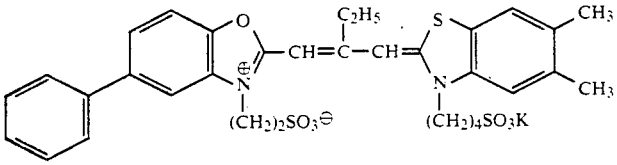
ExS-7
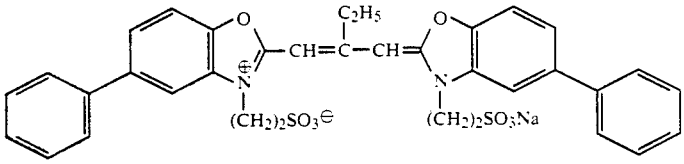
ExS-8
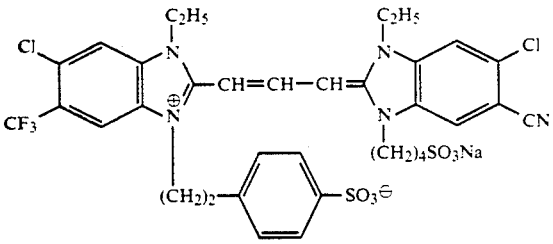
ExS-9
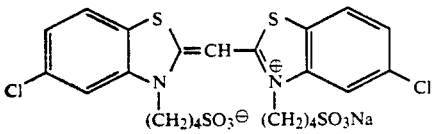
H-1
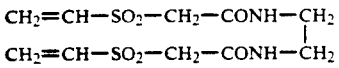
Cpd-3
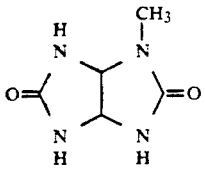

-continued

Cpd-4

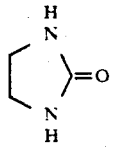

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material which has at least one silver halide emulsion layer on a support, wherein at least one type of cyan coupler which is represented by general formula (A) indicated below is included in at least one layer, a high boiling point organic solvent is present in the layer which contains said coupler in a weight ratio of zero to not more than 0.3 with respect to said coupler in said layer, and an ultraviolet absorber is included in said layer at a rate of at least 0.05 in terms of the ratio by weight with respect to said cyan coupler:

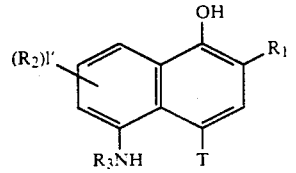

(A)

wherein $R_1$ represents a halogen atom, an aliphatic group, an aromatic group, a heterocyclic group, an amidino group, a guanidino group, or a $—COR_4$, $—SO_2R_4$, $—SOR_4$, $—NHCOR_4$, $—NHSO_2R_4$, $—NHSOR_4$, or $R_2$ represents a halogen atom, a hydroxyl group, a carboxyl group, a sulfo group, an amino group, a cyano group, a nitro group, an aliphatic group, an aromatic group, a carboxyamido group, a sulfonamido group, a carbamoyl group, a sulfamoyl group, a ureido group, an acyl group, an acyloxy group, an aliphatic oxy group, an aromatic oxy group, an aliphatic sulfonyl group, an aromatic sulfonyl group, an aliphatic sulfinyl group, an aromatic sulfinyl group, an aliphatic oxycarbonyl group, an aromatic oxycarbonyl group, an aliphatic oxycarbonylamino group, an aromatic oxycarbonylamino group, a sulfamoylamino group, a heterocyclic group or an imido group, l' represents an integer of from 0 to 3, $R_3$ represents a hydrogen atom or an $R_6U$ group, and T represents a hydrogen atom or a group which can be released by means of a coupling reaction with an oxidized form of a primary aromatic amine developing agent; $R_4$ and $R_5$ each independently represents an aliphatic group, an aromatic group, a heterocyclic group, an amino group, an aliphatic oxy group or an aromatic oxy group, $R_6$ represents a hydrogen atom, an aliphatic group, an aromatic group, a heterocyclic group, an $—OR_7$, $—SR_7$, $—COR_8$,

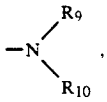

$—PO(R_7)_2$, $—PO(—OR_7)_2$,

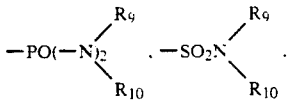

$—CO_2R_7$, $—SO_2R_7$ or $—SO_2OR_7$ group, or an imido group, and U represents

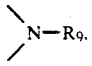

$—CO—$, $—SO_2—$, $—SO—$ or a single bond; $R_7$ represents an aliphatic group, an aromatic group or a heterocyclic group, $R_8$ represents a hydrogen atom, an aliphatic group, an aromatic group or a heterocyclic group, and $R_9$ and $R_{10}$ each independently represents a hydrogen atom, an aliphatic group, an aromatic group, a heterocyclic group, an acyl group, an aliphatic sulfonyl group or an aromatic sulfonyl group; in those cases where l' is 2 or 3, the $R_2$ groups may be the same or different, and they may be joined together to form a ring; $R_2$ and $R_3$, or $R_3$ and T may be joined together to form a ring; and dimers or larger units (oligomers or polymers) can be formed by linking with divalent groups or groups of higher valency in any of the groups $R_1$, $R_2$, $R_3$ or T.

2. The photosensitive material according to claim 1, wherein the ratio by weight of the ultraviolet absorber with respect to the cyan coupler is from 0.10 to 0.80.

3. The photosensitive material according to claim 1, wherein the ratio by weight of the ultraviolet absorber with respect to the cyan coupler is from 0.20 to 0.50.

4. The photosensitive material according to claim 1, wherein the ratio by weight of the organic component with respect to the binder which are included in the emulsion layer which contains the cyan coupler is from 0.2 to 1.0.

5. The photosensitive material according to claim 1, wherein the ratio by weight of the organic component with respect to the binder which are included in the emulsion layer which contains the cyan coupler is from 0.2 to 0.8.

6. The photosensitive material according to claim 1, wherein the amount of the high boiling point organic solvent is determined with respect to the total weight of coupler contained in a single layer and is at the most 0.3 g per g of coupler.

7. The photosensitive material according to claim 1, wherein the amount of the high boiling point organic solvent is determined with respect to the total weight of coupler contained in a single layer and is at the most 0.15 g per g of coupler.

8. The photosensitive material according to claim 1, wherein the amount of the high boiling point organic solvent is determined with respect to the total weight of coupler contained in a single layer and is at the most 0.05 g per g of coupler.

9. The photosensitive material according to claim 1, wherein the amount of the high boiling point organic solvent is determined with respect to the total weight of coupler contained in a single layer and is at the most 0.01 g per g of coupler.

10. The photosensitive material according to claim 1, wherein the amount of the high boiling point organic solvent is 0 g.

11. The photosensitive material according to claim 1, wherein the ultraviolet absorber is represented by the following general formulae (I) to (IV).

(I)

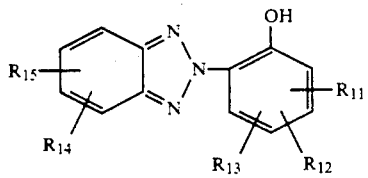

(II)

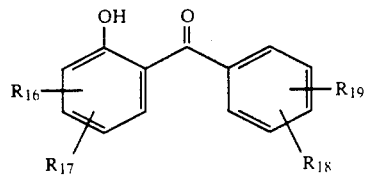

(III)

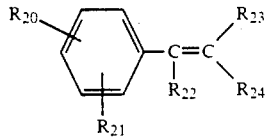

(IV)

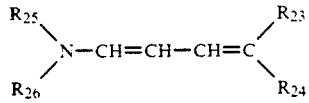

wherein $R_{11}$ to $R_{15}$, which may be the same or different, each represents a hydrogen atom, a halogen atom, an acyloxy group having from 1 to 18 carbon atoms, an aliphatic group having from 1 to 18 carbon atoms, an aromatic group having from 6 to 24 carbon atoms, $R_{27}O$— or $R_{27}SO_2$—, $R_{16}$ to $R_{19}$, which may be the same or different, each represents a hydrogen atom, a halogen atom, a hydroxyl group, an aliphatic group having from 1 to 18 carbon atoms, an aromatic group having from 6 to 24 carbon atoms, a carboxamido group, a sulfonamido group, a sulfo group, a carboxyl group or $R_{27}O$—, $R_{20}$ and $R_{21}$, which may be the same or different, each represents a hydrogen atom, an aliphatic group having from 1 to 18 carbon atoms, a halogen atom or $R_{27}O$—, $R_{22}$, $R_{25}$ and $R_{26}$, which may be the same or different, each represents a hydrogen atom, an aliphatic group having from 1 to 18 carbon atoms, or an aromatic group having from 6 to 24 carbon atoms (but both $R_{25}$ and $R_{26}$ cannot both be hydrogen atoms at the same time). $R_{23}$ and $R_{24}$, which may be the same or different, each represents a cyano group, a carbamoyl group, a sulfamoyl group, a formyl group, —$COR_{27}$, —$SOR_{27}$, —$SO_2R_{27}$, —$SO_2OR_{27}$ or —$COOR_{27}$, and $R_{27}$ represents an aliphatic group having from 1 to 18 carbon atoms or an aromatic group having from 6 to 24 carbon atoms; in the above groups $R_{11}$ to $R_{27}$, an aliphatic group is a substituted or unsubstituted straight chain, branched chain or cyclic alkyl group, and an aromatic group is a group which has a substituted or unsubstituted single benzene ring or condensed benzene ring.

12. The photosensitive material according to claim 1, wherein the high boiling point organic solvents is selected from the group consisting of a phosphoric acid ester, a benzoic acid ester, a fatty acid ester, an amide, a dialkylaniline, a chlorinated paraffin, a phenol, and a phthalic acid ester.

13. The photosensitive material according to claim 1, wherein the high boiling point organic solvent is a phosphoric acid ester or a phthalic acid ester.

14. The photosensitive material according to claim 1, wherein the coupler represented by general formula (A) is in the form of an oligomer which contains repeating units of general formula (B):

(B)

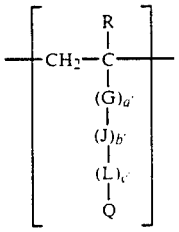

wherein R represents a hydrogen atom, an alkyl group which has from 1 to 4 carbon atoms or a chlorine atom, G represents —CONH—, —COO— or a substituted or unsubstituted phenylene group, J represents a substituted or unsubstituted alkylene group, phenylene group or aralkylene group, and L represents —CONH—, —NHCONH—, —NHCOO—, —NHCO—, —OCONH—, —NH—, —COO—, —OCO—, —CO—, —O—, —$SO_2$—, —$NHSO_2$— or —$SO_2NH$—, a', b' and c' each represents 0 or 1, and Q represents a cyan coupler residual group in which a hydrogen atom other than that of the hydroxyl group in the 1-position has been removed from a compound which can be represented by general formula (A).

* * * * *